US009206683B2

(12) United States Patent
Blair et al.

(10) Patent No.: US 9,206,683 B2
(45) **Date of Patent: *Dec. 8, 2015**

(54) OIL AND GAS WELL FRACTURE LIQUID TRACING USING DNA

(71) Applicants: Tyler W. Blair, Midland, TX (US); Richard K. Baldwin, San Diego, CA (US)

(72) Inventors: Tyler W. Blair, Midland, TX (US); Richard K. Baldwin, San Diego, CA (US)

(73) Assignee: Trace Logic, Inc., Midland, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/706,581

(22) Filed: May 7, 2015

(65) Prior Publication Data

US 2015/0322776 A1 Nov. 12, 2015

Related U.S. Application Data

(63) Continuation-in-part of application No. 14/273,199, filed on May 8, 2014, which is a continuation-in-part of application No. 13/956,864, filed on Aug. 1, 2013.

(51) Int. Cl.
*E21B 47/10* (2012.01)
*E21B 43/26* (2006.01)

(52) U.S. Cl.
CPC ..... *E21B 47/1015* (2013.01); *E21B 43/26* (2013.01)

(58) Field of Classification Search
CPC ..... E21B 47/10
See application file for complete search history.

(56) References Cited

U.S. PATENT DOCUMENTS

2001/0036667 A1* 11/2001 Tayebi ..... E21B 47/1015 436/56
2009/0151938 A1* 6/2009 Conkle ..... E21B 43/26 166/254.1
2009/0226907 A1* 9/2009 Nice ..... C12Q 1/68 435/6.12
2011/0277996 A1* 11/2011 Cullick ..... E21B 33/138 166/250.12

* cited by examiner

*Primary Examiner* — Catherine Loikith
*Assistant Examiner* — Ryan Schneer
(74) *Attorney, Agent, or Firm* — Dan Brown Law Office; Daniel R. Brown

(57) ABSTRACT

Tracing fracking liquid in oil and gas wells using unique DNA sequences. For each of the DNA sequences, bonding to magnetic core particles, and encapsulating them with silica. Pumping the volumes of fracking liquid, each marked with one of the unique DNA sequences, into the well. Pumping fluids out of the well while taking fluid samples. For each of the plural fluid samples, gathering the silica encapsulated DNA using magnetic attraction with the magnetic core particles, dissolving away the silica shells, thereby separating the plural unique DNA sequences form the magnetic core particles, and analyzing the concentration of the unique DNA sequences in each of the plural fluid samples. Then, calculating the ratio of each of the volumes of fracking liquid recovered for each of the fluid samples, and thereby establishing the quantity of the volumes of fracking liquids removed from the fracture zones.

22 Claims, 8 Drawing Sheets

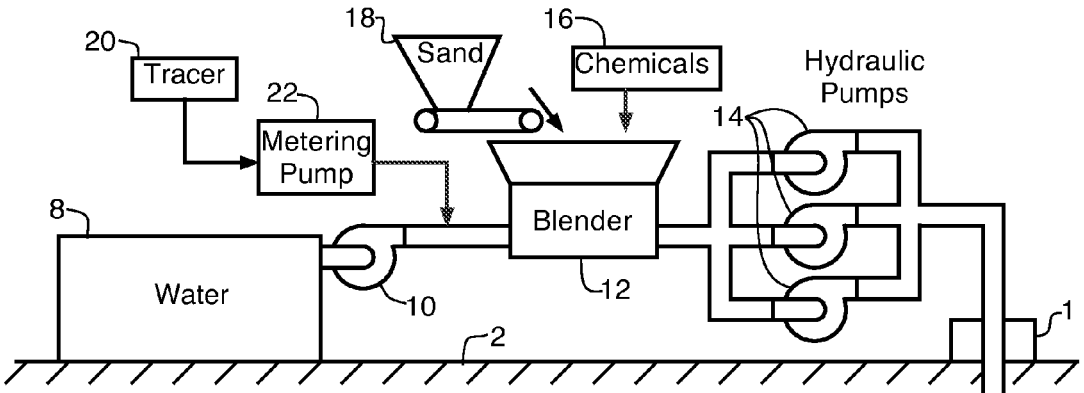
Fig. 1
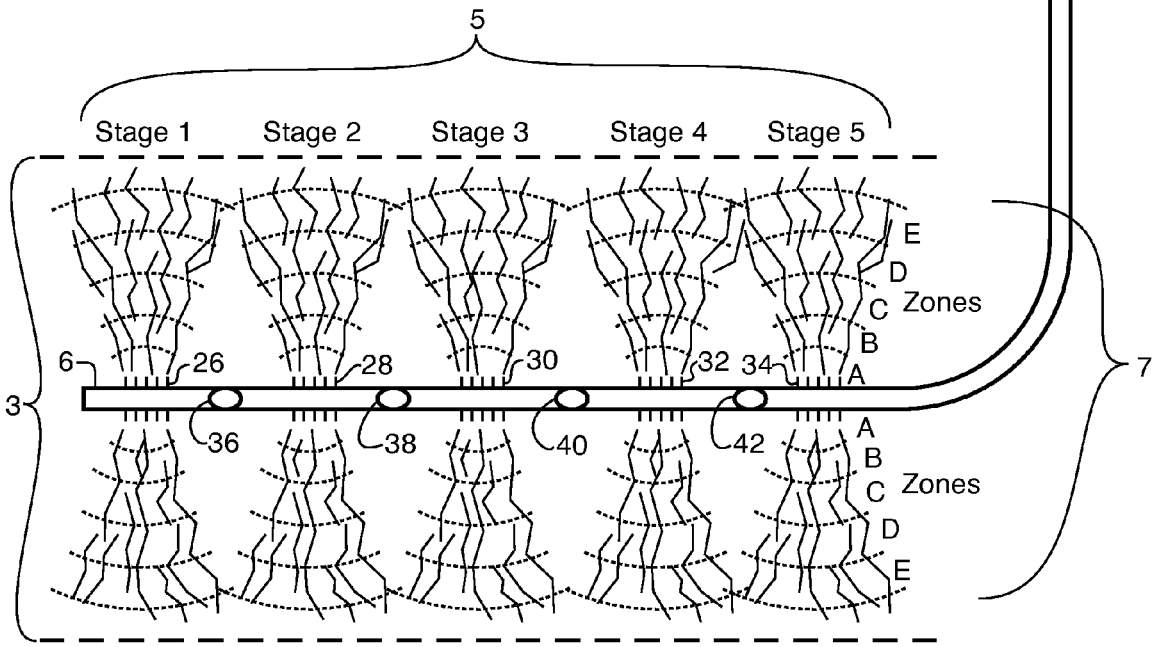

200

206

246

248

OIL AND GAS WELL FRACTURE LIQUID TRACING USING DNA

RELATED APPLICATIONS

This is a continuation-in-part application from U.S. application Ser. No. 14/273,199 filed on May 8, 2014, which is a continuation-in-part from U.S. application Ser. No. 13/956,864 filed on Aug. 1, 2013.

BACKGROUND OF THE INVENTION

1. Field of the Invention

The present invention relates to hydraulic fracturing of geologic formations in hydrocarbon wells. More particularly, the present invention relates to tracing the movement and recovery of hydraulic fracturing liquids pumped into oil and gas wells using plural unique DNA or oligonucleotides tracing compounds, which correspond with plural fracture stages and zones within a geologic formation.

2. Description of the Related Art

Oil and gas are removed from geologic formations by drilling a well bore from the surface. A well casing is inserted into the well bore, which is then perforated so that oil and gas can flow from the adjacent geologic formation into the well casing. The oil and gas may flow upwardly under natural pressure in the formation, but more commonly they are removed using an artificial lift system, such as the well-known sucker-rod pump and surface-mounted pump-jack arrangement. In order to maintain production over an extended period of time, there must be sufficient formation porosity and pressure so that the oil and gas naturally flow from the hydrocarbon bearing geologic formation, through the casing perforations, and into the well casing.

As exploration has expanded into regions where there is insufficient porosity in the oil and gas bearing formations to sustain production, engineers have developed hydraulic fracturing techniques that produce artificial porosity, through which the formation oil and gas can flow into the well casing. Hydraulic fracturing is the fracturing of rock structures adjacent to the well casing perforations using a pressurized liquid pumped down the well casing from the surface. Hydraulic fracturing, or hydrofracturing, also commonly referred to as "fracking", is a technique in which fresh water is mixed with sand and certain chemicals, and then the mixture is injected at high pressure into a well casing to create small fractures in the formation. This liquid mixture is referred to as fracking liquid. These small fractures enable formation fluids, such as gas, crude oil, and brine water to flow into the well casing. Once the fracking process is completed, hydraulic pressure is removed from the well. The formation rock naturally settles back to its original position, but the small grains of sand, referred to as proppants, hold these fractures open so as to yield the desired artificial porosity. Fracking techniques are commonly used in wells for shale gas, tight gas, tight oil, coal seam gas, and hard rock wells. The fracking process is only utilized at the time the well is drilled and placed into production, but it greatly enhances fluid removal and well productivity over the life of the well.

The sequence of events implemented to place a typical oil or gas well into production generally consists of drilling the well bore, installing the well casing, perforating the casing, hydrofracturing the hydrocarbon bearing formation, installing an artificial lift system, recovering the hydraulic fracturing liquid, and then producing oil and gas from the well. It is significant to note that the presence of the fracturing liquid in the formation interferes with oil and gas production, and that removal of the fracturing liquid is a technical challenge for operators, and one that must be accomplished promptly, and to a reasonable degree of completion before oil or gas production from the well can commence. This disclosure is primarily concerned with the hydraulic fracturing process and the removal, or other disposition, of the hydraulic fracturing liquid (also referred to herein as "fracking liquid"). The types of wells contemplated herein include common vertical wells and wells in which horizontal drilling is used to traverse a geologic formation so as to increase productivity. In fact, hydraulic fracturing is now commonly employed in wells having horizontal bores through gas producing formations. An example of this is the Barnett Shale formation in north Texas, a region that covers approximately seventeen counties and contains natural gas reserves proven to include 2.5 trillion cubic feet, and perhaps as much a 30 trillion cubic feet of recoverable reserves.

The effectiveness of the hydraulic fracturing process, as well as the flow and disposition of the fracking liquid, is of critical importance to the well operator. Since the fracking process occurs far below the surface and is therefore difficult to monitor, any data that confirms the extent of the fractures or indicates the flow and movement of the fracking liquid is helpful in the operation of that well, and is also informative with regard to similar wells that may be drilled in the same oil field. A technique used to determine the flow and movement of the hydraulic fracturing fluid is called tracing. The tracing process involves placing a marking additive (hereinafter a "tracer") in the hydraulic fracturing liquid before it is pumped into the well, and then monitoring the fluids subsequently recovered from the well to determine the concentration of the tracer in the well fluids recovered. The concentration of the recovered tracer is compared with the concentration originally pumped into the well, and this is used to estimate the amount of the original fracking liquid that has been recovered. Generally, once a substantial portion of the fracturing liquid has been recovered, the well is placed into production.

Fracturing liquids contain a number of additives and chemicals that are used to facilitate the fracturing process. Among these are specialized sand that is used as a proppant, a thickening or gelling agent that increases viscosity thereby enabling the water to carry the proppant into the fractures, acid used to control pH of the well, a breaking agent that later reduces the viscosity so that the fracturing liquid can be more readily recovered, and numerous other chemical treatment, the details of which are beyond the scope of this disclosure. Some consider a portion of these additives and chemicals to be environmentally questionable, and so the movement of the fracturing liquid is monitored with respect to migration of the fracturing liquids into adjacent formations, possibly including fresh water resources. Thus, it is useful to monitor migration of subterranean fluid movements by detecting the tracer in adjacent oil wells and other access points, such as nearby injection wells and water wells. The fracturing liquids also impede production of oil and gas, and operators take a number of actions to facilitate their removal. This may include chemical treatments to alter the fracture liquids to enhance their removal, and also the addition of flushing liquids to dilute or alter the nature of the fracturing liquids.

Various types of tracers have been employed in hydraulic fracturing liquids. Selection and implementation of a tracer is non-trivial because of the cost constraints and the harsh environment that oil and gas wells present. The tracing material needs to be economically feasible in large scale drilling operations, it must be readily detectable at very low concentrations using commercially available test equipment, and it must survive the extremes of pressure and temperature, and the chemical and biological environment present in oil and gas wells. It is known to use certain chemical tracer compounds, fluorescent dye tracers, radioactive isotope tracers, fluorinated benzoic acid, ionized salts, and certain other chemicals. However, the number of discrete and unique tracers that can be used in a single hydraulic fracturing job is quite limited, and is generally just a handful that would be practicable in a single fracking job. This is a significant limitation because an operator cannot monitor a complex fracking job in detail. Many jobs use only a single tracer, which only enables the tracing of the fracking liquids in total. Some jobs can use individual tracers for a few stages of a fracking job. Thus it can be appreciated that there is a need in the art for a system and method of tracing hydraulic fracturing liquid that provides greater flexibility, greater detail, and accuracy in a reliable and cost effective manner.

SUMMARY OF THE INVENTION

The need in the art is addressed by the teachings of the present invention. The present disclosure teaches a method of tracing fracking liquid in oil or gas bearing formations using plural unique DNA sequences as fluid markers. The method includes the steps of, for each of the plural unique DNA sequences, bonding a unique DNA sequence to a group of magnetic core particles, depositing a silica shell about the magnetic core particles, and thereby encapsulating the unique DNA sequence in silica. The method continues by pumping the plural volumes of fracking liquid, each marked with one of the silica encapsulated unique DNA sequences, into the formation, thereby defining plural fracture zones in the formation. Then, pumping fluids out of the formation while taking plural fluid samples. And, for each of the plural fluid samples, gathering the silica encapsulated unique DNA sequences using magnetic attraction with the magnetic core particles, dissolving away the silica shells, thereby separating the plural unique DNA sequences from the magnetic core particles, and analyzing the concentration of the unique DNA sequences in each of the plural fluid samples. Then, calculating the ratio of each of the plural volumes of fracking liquid recovered for each of the plural fluid samples according to the concentration of the unique DNA sequences present in each of the plural samples, and thereby establishing the quantity of the plural volumes of fracking liquids removed from the plural fracture zones.

In a specific embodiment of the foregoing method, the bonding DNA to a group of magnetic particles step is accomplished using electrostatic attraction. In a refinement to this embodiment, the electrostatic attraction is enabled by silanization of the magnetic particle.

In a specific embodiment of the foregoing method, the gathering step is accomplished using a magnet that is fixed within a sample vessel. In another specific embodiment, the method further includes removing the magnetic particles by magnetic attraction. In another specific embodiment, the foregoing method further includes the steps of removing the magnetic particles by precipitation and decanting the DNA off of the magnetic particles.

The present disclosure also teaches a method of tracing fracking liquid in oil or gas bearing formations using plural unique DNA sequences as fluid markers. This method includes the steps of, for each of the plural unique DNA sequences, biotinylating the unique DNA sequence, bonding the biotinylated unique DNA sequence to a group of magnetic core particles, and depositing a silica shell about the magnetic core particles, thereby encapsulating the biotinylated unique DNA sequence in silica. The method further includes pumping the plural volumes of fracking liquid, each marked with one of the silica encapsulated biotinylated unique DNA sequences, into the formation, thereby defining plural fracture zones in the formation, then pumping fluids out of the formation while taking plural fluid samples. Next, for each of the plural fluid samples, separating the silica encapsulated biotinylated unique DNA sequences from the fluid sample using magnetic attraction with the magnetic core particles, dissolving away the silica shells, thereby separating the plural biotinylated unique DNA sequences from the magnetic core particles, gathering the biotinylated unique DNA sequences by bonding to avidin or streptavidin that has been immobilized onto a magnetic carrier, and analyzing the concentration of the biotinylated unique DNA sequences in each of the plural fluid samples. The method is completed by calculating the ratio of each of the plural volumes of fracking liquid recovered for each of the plural fluid samples according to the concentration of the unique DNA sequences present in each of the plural samples, and thereby establishing the quantity of the plural volumes of fracking liquids removed from the plural fracture zones.

In a specific embodiment, the foregoing method further includes removing the plural biotinylated unique DNA sequences from the magnetic core particles. In a refinement to this embodiment, the removing step is accomplished by cleaving the biotin bond using a cleaving agent. In another specific embodiment, the foregoing method further includes removing the separated magnetic core particles from the sample using magnetic attraction.

The present disclosure also teaches a method of tracing fracking liquid in oil or gas bearing formations using plural unique DNA sequences as fluid markers. The method includes, for each of the plural unique DNA sequences, depositing a first silica shell about a group of magnetic core particles, inducing a positive charge on the encapsulated magnetic core particles, bonding a unique DNA sequence, having a negative charge, to the positively charged encapsulated magnetic core particles, and depositing a second silica shell about the bonded magnetic core particles, thereby encapsulating the unique DNA sequence in silica. The method also includes pumping the plural volumes of fracking liquid, each marked with one of the silica encapsulated unique DNA sequences, into the formation, thereby defining plural fracture zones in the formation, pumping fluids out of the formation while taking plural fluid samples. The method also includes, for each of the plural fluid samples, gathering the silica encapsulated unique DNA using magnetic attraction with the magnetic core particles, dissolving away the first silica shells and second silica shells, thereby separating the plural unique DNA sequences from the magnetic core particles, and analyzing the concentration of the unique DNA sequences in each of the plural fluid samples. The method is completed by calculating the ratio of each of the plural volumes of fracking liquid recovered for each of the plural fluid samples according to the concentration of the unique DNA sequences present in each of the plural samples, and thereby establishing the quantity of the plural volumes of fracking liquids removed from the plural fracture zones.

In a specific embodiment, the foregoing method further includes inducing a positive charge on the encapsulated magnetic core particles. In another specific embodiment, the inducing step is accomplished by applying a positively charged amino-saline to the encapsulated magnetic core particles.

BRIEF DESCRIPTION OF THE DRAWINGS

FIG. 1 is a system diagram of the hydraulic fracturing process according to an illustrative embodiment of the present invention.

DESCRIPTION OF THE INVENTION

Figure 2:
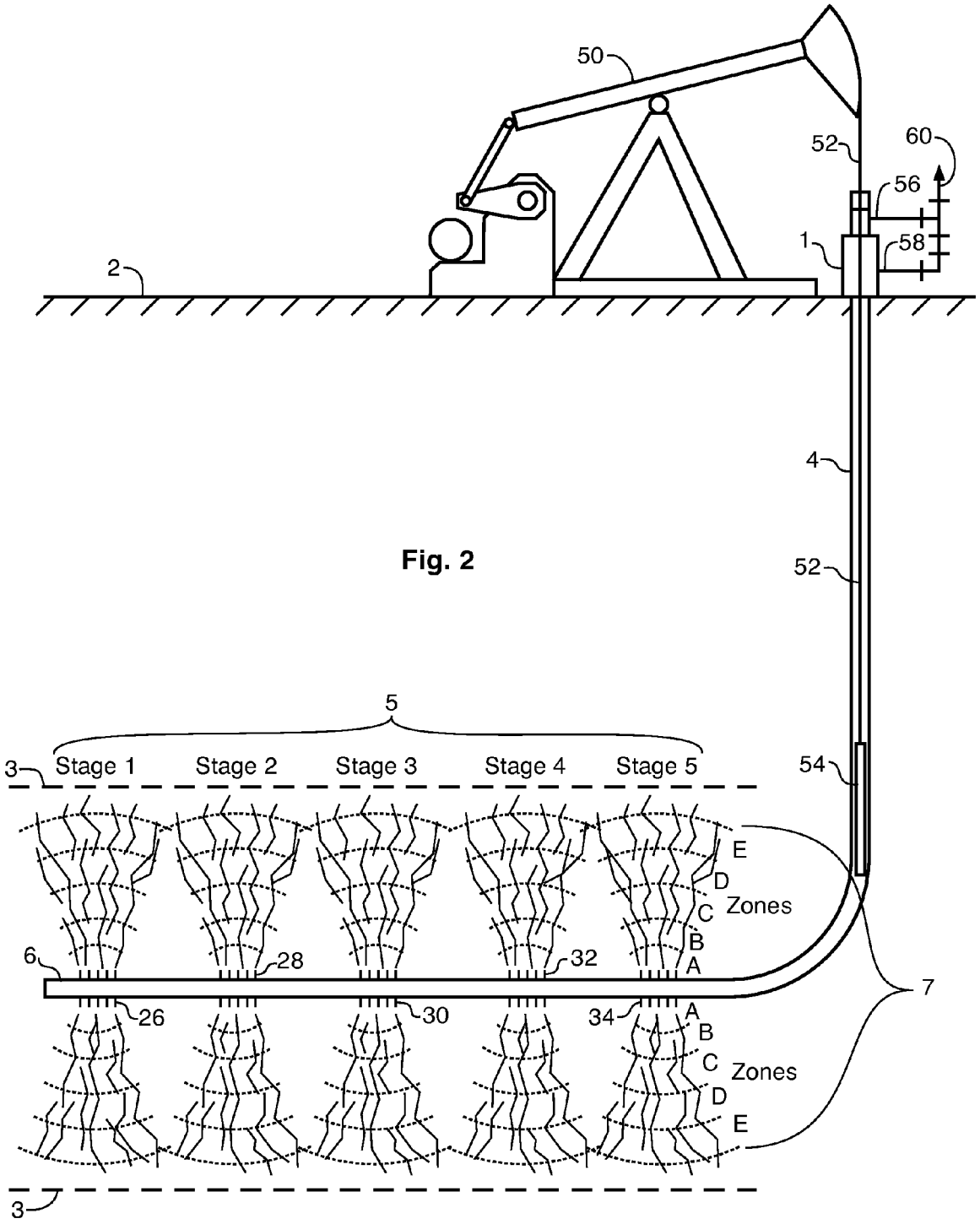
FIG. 2 is a system diagram of the fracking liquid removal process according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods or components to form various apparatus and systems. Accordingly, the apparatus and system components and method steps have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, upper and lower, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

As mentioned hereinbefore, it is important to remove as much of the fracking liquid as possible prior to placing a well into production. The fracking liquid interferes with production for a number of reasons, one of which is the fact that viscosity interferes with flow of reservoir fluids into the well casing. Certain chemical treatments are included in the fracking liquid to reduce its viscosity, called breaking agents. The breaking agents operate over time such that the fracking liquid is viscous as it is pumped into the well, but less viscous when it is pumped out. The fracking liquid is pumped into the formation in several discrete stages, which correspond to several sets of perforations through the well casing, which are located at various depths within the formation. At each stage of the perforations, there are typically several sub-stages injected in the fracture process. The sub-stages may each have a different fracking liquid blend, most often including different proppant material configurations. For example, different sieve size sand or different amounts of sand added to each barrel of fracking liquid. As these sub-stages of fracking liquid are pumped in, they each define different fracture zones within any given fracture stage. Each subsequent sub-stage of fracking liquid pumped into a given stage pushes the previous stage outwardly from the casing perforations. Thus, each zone in the fracture may have a different fracking liquid profile, generally corresponding to the sub-stages. At the time this fracking liquid is recovered from the well, the individual zones drain back into the well casing and are pumped out. The operator of the well desires to understand the performance of the fracking job, including details on how individual zones have been fractured, and how the fracking liquid from each has been recovered, including the volume of liquid and the time taken for the recovery process to occur.

Wells that includes a horizontal bore into a formation commonly include ten or more perforation stages. Each stage may include from five to as many as thirty sub-stages, which corresponds to perhaps two hundred fracture zones in a given well. Ideally, an operator would like to know about the removal of fracking liquid from every zone. Unfortunately, current tracer variants are far more limited in number. It would be challenging to assemble twenty discrete tracing compounds to use in a given well, which places a clear limit on the amount of information an operator can garner during the fracking liquid removal process. The reason this is challenging is because of the extreme and hostile environment present in an oil and gas well. In addition to presenting a complex chemical environment, there is generally an acidic pH, high pressures, turbulent and shear forces, and high temperatures in a well during the fracking process. In order to function reliably, each tracer compound must survive the down-hole environment without alteration of any kind, and each tracer should not react with any chemical compounds present in the well. There can also be biological and enzymatic issues in the well that affect the tracers. In addition, the tracer compounds must be economically feasible, and must be detectible at very low concentrations (in the order of parts per billion or trillion) using commercially available test equipment. Furthermore, during the detection and measurement processes, it may be necessary to remove the tracer compounds from the well formation fluid, and concentrate them, prior to performing a test of its recovered concentration.

The present disclosure teaches the use of plural oligonucleotide compounds as hydraulic fracture liquid tracers. The present disclosure also presents specific handling and automation systems, as well as specific test methodologies. These oligonucleotides include deoxyribonucleic acid (DNA), ribonucleic acid (RNA), and locked nucleic acid (LNA), each configured with a unique sequence that can be readily discriminated using certain mass spectrometer test equipment and methodologies.

Reference is now directed to FIG. 1, which is a system diagram of the hydraulic fracturing process according to an illustrative embodiment of the present invention. At the surface level 2, a wellhead 1 is coupled to a well casing 4, which continues downwardly to a horizontal casing 6 that was drilled and installed into an oil and gas bearing geologic formation 3. In FIG. 1, the well has been drilled and cased, and five stages 5 of perforations and fractures have been completed. The various components of the hydraulic fracturing equipment are shown on the surface 2. The hydraulic fracturing process occurs in a coordinated fashion, stage by stage 5, and zone by zone 7, until all of the zones 7 have been fractured. Each individual zone, referenced by a combination of its stage number 5 and its zone number 7, corresponds to a sub-stage of the fracturing process, and may also have utilized a distinct fracturing liquid mixture, and may have been marked with a unique tracing oligonucleotide.

At the surface 2, plural hydraulic pumps 14 force fracking liquid down the casing 4 at very high pressure. The hydraulic pumps 14 are fed mixed fracking liquid from a blender 12. The blender 12 operates on a continuous basis during each stage 5 of the fracking job, continually being fed with the various components of the particular fracking liquid mixture presently required by a fracking job specification. The fracking job specification is generated by petroleum engineers prior to commencement of the job, and its details are beyond the scope of this disclosure. With respect to this disclosure, the fracking liquid mixture components are divided into water 8, chemicals 16, sand, or proppant, 18, and tracer compounds 20. The water 8 is the largest portion of the fracking liquid, and it is pumped into the blender 12 by a water pump 10, which supplies the water 8 at a predetermined rate according to the fracking job specification. Similarly, the sand 18 is fed on a conveyor at a predetermined rate, and enters an opening in the top of the blender 12. The chemicals 16 can be fed in various manners depending on their respective material handling properties. The tracer compounds 20 are fed in precisely using a positive displacement metering pump 22. This is necessary because the concentration of the tracers 20 are so small, typically on the order of parts per million, or less.

The fracking job of FIG. 1 proceeds according to a sequential schedule. In this illustrative embodiment, that fracking schedule includes five stages 5 (labeled Stage 1 through Stage 5), each having five sub-stages that result in five fracture zones 7 (labeled Zone A through Zone E) each, for a total of twenty-five individual zones. Since each zone is to receive a unique fracking liquid blend according to the fracking schedule, and since there is just the single well casing 4, 6 to serve as the fracking liquid delivery conduit, it is necessary to sequence the preparation and delivery of the fracking liquid. Naturally, this begins with Stage 1, which is furthest from the wellhead 1. A set of perforations 26 are formed through the casing 6, accessing the formation 3 at the location of Stage 1. The surface 2 equipment is activated, and the fracking liquid, which also includes a unique oligonucleotide marker for Stage 1-Zone E, is pumped down the casing 4, 6. This liquid passed through the perforations 26 and into the formation. On a continuous pumping basis, the subsequent four zones (Zone D, Zone C, Zone B, and Zone A of Stage 1) are pumped through the perforations 26. Note that each zone receives a distinct fracking liquid mixture according the fracking schedule, and that each also receives a unique oligonucleotide marker. Also, note that the zones are pumped in reverse order, where each subsequent zone pushes the prior zone's fracking liquid outwardly into the formation, fracturing it as they progress. In other words, Zone E is pumped first, followed by Zone D, Zone C, Zone B, and Zone A. When Stage 1 is complete, a pressure seal 36 is inserted into the casing to isolate Stage 1 from the next sequence of events.

The pressure seal 36 may be a type of composite plug, as are known to those skilled in the art. Once plug 36 is in place, then the set of perforations 28 for Stage 2 are formed, and the next five sub-stages of fracking liquid with unique oligonucleotides are pumped to form the five fracture zones of Stage 2. Then, plug 38 is inserted to isolate Stage 2 from the subsequent Stage 3. This process repeats for Stage 3, with perforations 30 and plug 40, Stage 4 with perforations 32 and plug 42, and finally Stage 5 with perforation 34. Each of the five stages 5 has five zones 7, and all twenty-five of the zones have a specific fracture liquid and a unique oligonucleotide disposed within fractures just formed in the formation 3.

The nature of the stages and fractures zones depends in large measure on the nature of the formation and the petroleum engineers' plan for the extent of the fracturing job. To give this a sense of scale, some exemplary well perforation and fracturing specifics are worth considering. A well may be from 5000 to 20,000 feet deep with horizontal sections extending out to 7000 feet and more. Off-shore wells are even deeper and longer. The well is drilled and then cased with steel casing, which is commonly 5.5" in diameter. The bottom of the casing is closed in some fashion so that it holds pressure. Once the well is cased, the drilling rig is removed, and a "wireline crew" perforates the casing at stage locations specified by the petroleum engineers. It is common to use seven to eleven stages in a single well, but other quantities are known as well. The perforation is done with plural inverted bullet shaped copper projectiles fired with shaped charges. Each projectile makes a 0.2 to 0.25 inch diameter hole in the casing. A single stage of perforations is typically about twenty feet long, but shorter lengths are used as well, and some perforations can be over one hundred feet long.

The plugs used between stages are generally a composite material that is compressed against the interior of the well casing to withstand pressures on the order of thousands of PSI. The plugs can later be drilled out, however some have a dissolvable core, which opens after several hours to several days later. In the case of dissolvable plugs, the fracture schedule must proceed at a pace commensurate with the rate at which the plugs dissolve.

As noted above, the fracturing process creates a false porosity in the formation. This is particularly useful in horizontal wells cut through shale deposits. A fracture zone can extend three hundred feet from the well casing. The sand, or proppant, holds the fractures open after the hydraulic fracking liquid pressure is removed. Various sizes of sand are utilized in the various zones. An additive is used to gel or thicken the fracking liquid because the increased viscosity enables the liquid to carry the proppant out into the fracture zones. The number of zones in each stage is typically in the four to ten range, but the use of as many as thirty zones in a single stage is known. Thus in a large fracture job, there could be fifteen stages with thirty zones each, totaling four hundred fifty zones, each of which could be marked with a unique oligonucleotide.

With respect to the pumping and pressures applied during the fracking process, fracking liquid flow rates can run 70-75 barrels per minute with pressures well over 7000 PSI. The pumping time for a single stage can range from one to four hours. A typical fracking job can utilize 2 million gallons of fracking liquid.

Reference is now directed to FIG. 2, which is a system diagram of the fracking liquid removal process according to an illustrative embodiment of the present invention. This figure generally corresponds to FIG. 1, after the hydraulic pressure has been removed from the well and the fracking equipment has been removed. This is the recovery phase of the project, where the fracking liquid is removed from the formation. The first step is to open the plugs of FIG. 1, which can be accomplished by drilling or through the use of dissolvable plugs. This action may allow some of the fracking fluids to flow out of the well due to the pressure built up in the fracturing process, but generally, a down-hole pump will be utilized to recover the fracking liquid. As the fracking liquid is removed, it is typically mixed with formation fluids. Note that while the fracking liquids pumped into the well area generally free of gases, the formation fluids comprise both liquids and gases. FIG. 2 illustrates the fracking liquid recovery process.

In FIG. 2, a down hole pump 54 has been inserted into the casing 4, which operates to pump fluids out of the formation, up the casing 6, 4, and to the wellhead 1. In this embodiment, a sucker rod 52 driven pump 54 is employed, however, a submersible pump can also be used, as is known to those skilled in the art. The sucker rod 52 couples the pump 54 to a reciprocating pump jack drive unit 50 at the surface 2, as are well known in the art. As fluids are removed from the casing, additional formation fluids and fracking liquids flow from the formation 3 and the fracture zones 7 into the casing 6. The wellhead 1 has a piping arrangement that routes the liquids from a tubing string 56 and gases from a casing annulus 58 to a fluid outlet 60. Samples of the fluid output 60 are periodically gathered for testing. This testing includes testing for the concentration of the several oligonucleotides that were mixed into the fracking liquid as the fracturing processed occurred.

It can be appreciated that the fracture liquids in the several zones 7 generally flow into the casing on a last-in, first-out basis, and the testing of oligonucleotides may demonstrate this general trend. However, that assumption would only hold true for a uniform formation with consistent porosity and uniform formation pressures. Further, such uniform flow would require that the consistency and break-down of the fracking liquid viscosity was uniform throughout the several zones. In reality, these assumptions would be very unlikely to hold true. There are many variables that affect the nature and rate at which the fracture liquids are recovered. First is the material and consistency of the formation, and the extent of hydrocarbon and brine fluids therein. These two factors are of interest to the operator, because they are indicators of the production potential of the well and also indicate the general nature of the reserve, which influences how nearby wells might be engineered. Another factor is the content of the fracture fluid mixture in each of the several stages. There can also be problems in the recovery process where certain stages do not readily release the fracking liquid, and therefore limit production potential for the well. The oligonucleotide concentration can indicate such problematic areas, and suggest alternative treatments for mitigating them.

Ideally, the well operator's goal is to remove all of the fracking liquid from the well, so that the well only produces formation fluids. In an exemplary well, approximately 2 million gallons of fracking liquid are used, and the recovery process goal is to remove all of this so that the well can be placed into production of oil and/or gas. In a typical well, perhaps 75% of the fracking liquid is actually recovered. It is useful to understand which of the plural zones' fracking liquid has been recovered, and where the 25% of unrecovered fracking liquid might be. This is only possible if all of the fracking liquid zones have been uniquely and discretely marked. With respect to when the well is transitioned from recovery of fracking liquids to production of oil and gas, once the toe perforation start to flow back, then it can be assumed that the well is ready for production. This is because the toe perforation was the last to be fractured, and will be the last to produce. Therefore, once this perforation starts to produce, then the whole well is likely to be ready for production. The unique oligonucleotides that marked the toe perforation stages will indicate to the operator when that stage is beginning to flow.

In an exemplary embodiment, well fluid samples are taken on a periodic basis, which gradually lengthens over time. For example, during the first day of recovery, a first sample can be taken shortly after the recovery pump starts operating, and then samples may be taken at four-hour intervals. The second day samples may be taken at eight-hour intervals, then twelve-hour intervals the next day, until just daily samples are taken. This can go on for a month, or until testing shows that most of the fracking liquids have been recovered. The rate at which fracking liquid and formation fluids are pumped out of the well varies widely, based on the characteristics of the formation. This may range from 1 bbl/day to 2000 bbl/day. In the exemplary well, the recovery rate is approximately 300 bbl/day. At initial pumping, the recovered fluids are nearly all fracking liquid, but by the end of the recovery period, only a small fraction of the pumped formation fluids is fracking liquid. Again, the oligonucleotide testing procedure provides detailed information on the rate of fracking liquid recovery.

Figure 3:
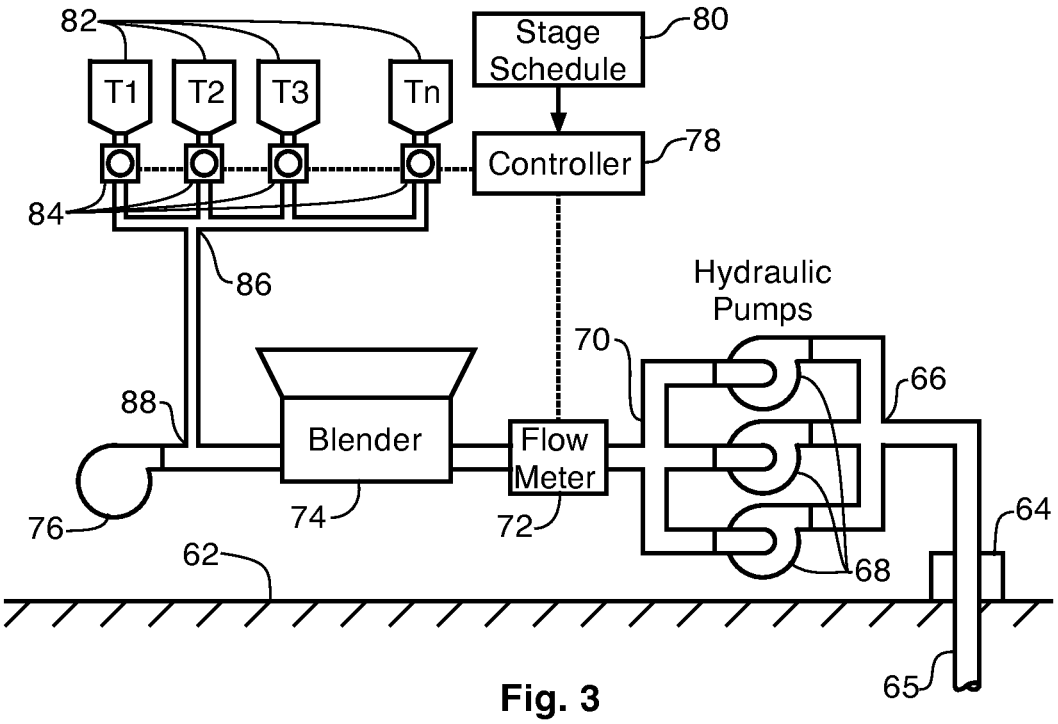
FIG. 3 is a system diagram of the oligonucleotide marking and pumping process according to an illustrative embodiment of the present invention.

Reference is now directed to FIG. 3, which is a system diagram of the oligonucleotide marking and pumping process according to an illustrative embodiment of the present invention. This figure illustrates the equipment at ground level 62 used to pump the fracking liquid into the wellhead 64 and down the casing 65. The water flows from an input pump 76, which is supplied from a high volume reservoir (not shown), and into a blender 74. The blender 74 has mechanical agitators inside, which combine and mix the water with sand and chemicals (not shown) on a continuous basis. In the illustrative embodiment the blender 74 has a mixing volume of approximately one hundred barrels. The volume of fracking liquid flowing out of the blender 74 is measured by a flow meter 72, which is used to monitor and maintain the volumetric flows according to the fracking schedule, and for general record keeping requirements. An input manifold 70 routes the fracking liquid to plural high-pressure fracking pumps 68. The outlets of the plural high-pressure pumps 68 are combined by an outlet manifold 66, which is coupled to the wellhead 64.

As was noted hereinbefore, petroleum engineers develop a fracking schedule that itemizes the mixture components of the several zones of each stage of a fracking job. This schedule is used as the basis for adding oligonucleotides into the blending process in concert with the other blended components. The individual zones are each marked with a unique oligonucleotide. Therefore, in FIG. 3, there are plural tracer tanks 82 that each contains a unique oligonucleotide. Each of the plural tracer tanks 82 is coupled to a corresponding metering pump 84. The metering pumps 84 run at fairly low volumetric rates, so peristaltic pumps are a suitable choice for this application. The output of the plural metering pumps 84 are combined by a manifold 86 and coupled to the blender 74 or the water feed line 88 into the blender 74.

Because the fracturing process is implemented on a continuous basis, and because there is a predetermined fracking schedule, the pumping of the oligonucleotides 82 can be automated. In the illustrative embodiment, the stage schedule 80 contains a database of the volumetric flow for each zone of every stage, and also the type and concentration for each of the discrete oligonucleotides. A controller 78, such as an industrial programmable logic controller, monitors the flow meter 72 and the stage schedule 80, and then activates the appropriate metering pump 84 so that the correct amount of oligonucleotide is pumped to yield the specified input concentration, which may be approximate one to five parts per million in the illustrative embodiment. Note that oligonucleotide is produced as a fine dry power. To facilitate the metering and pumping operations, the oligonucleotides are mixed with fresh water into high concentration slurry, and are then placed into the tracer tanks 82. Agitation may be required to maintain a uniform slurry concentration in the tracer tanks 82.

Figure 4:
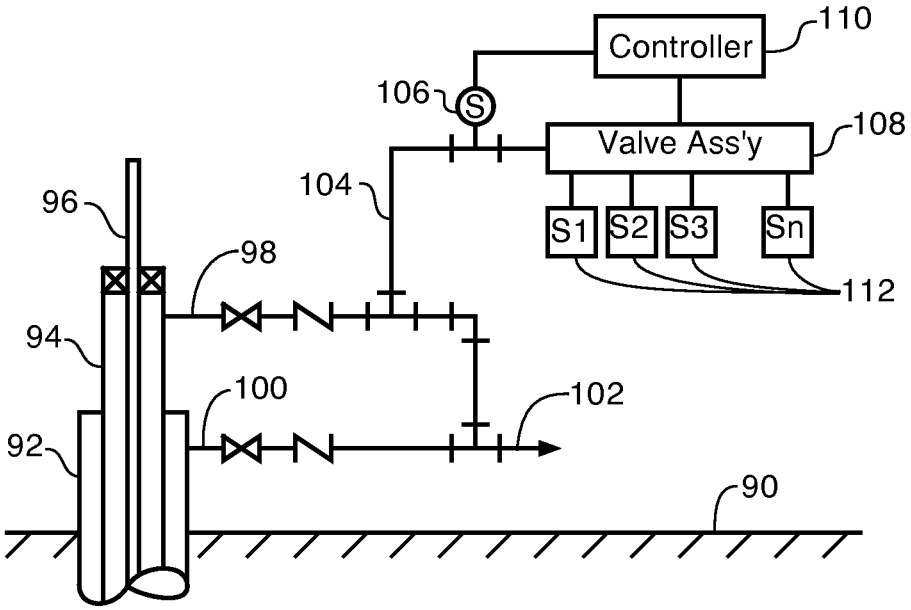
FIG. 4 is a system diagram of the formation fluid sampling process according to an illustrative embodiment of the present invention.

Reference is now directed to FIG. 4, which is a system diagram of the formation fluid sampling process according to an illustrative embodiment of the present invention. This figure illustrates a more detailed view of the well fluid sampling system, and also shows an automated sampling embodiment. At the ground level 90, the wellhead comprises the well casing 92, a tubing string 94, and the sucker rod 96, which drives the down-hole pump. Generally, fluids are pumped up the tubing string 94, and gases flow up the casing 92 annulus. Although, the well fluids often times have a high percentage of gas content, as is know to those skilled in the art. A fluid pipeline 98 is coupled to the tubing string 94, and a gas pipeline 100 is coupled to the casing 92 annulus. Suitable valves are used, and the well fluids are output 102 to a storage or transportation system (not shown). The illustrative embodiment utilizes a sampling line 104 connected to the fluid pipeline 98, which is used to draw periodic samples of the well fluids, which would include some of the fracking liquids.

In the automated sampling embodiment of FIG. 4, the sampling is accomplished periodically and automatically using a solenoid valve 106 under control of an industrial programmable controller 110. At predetermined intervals, the controller 110 opens the solenoid valve 106 to allow well fluids to pass into the valve body 108. The valve body 108 automatically routes each sample of well fluid to a predetermined sample vessel 112. An operator periodically visits the well site to retrieve the sample vessels 112, and replace them with empty vessels. This arrangement facilitates more accurate sample gathering and less operator involvement. Once the samples are gathered, they are ready for processing and measurement of the concentrations of the plural oligonucleotides originally pumped in with the fracking liquid.

Once the samples are gathered from the wellhead, testing for the concentrations of the plural oligonucleotides is undertaken, and then calculations are made to establish the volume of fracking liquids that have been removed per sample period. These values, gathered over the several sampling periods, are then used to establish the totality of the fracking liquid recovery process, which is presented in table form for the well operator's uses. It will be appreciated by those skilled in the art that the raw well fluids are challenging to deal with, and are hard on all the instruments that are used in the sampling and measuring process. These fluids contain brine, crude oil, dissolved gases, gas bubbles, acids, solids, various well chemicals, the fracking liquid, and the oligonucleotide tracers. The raw well fluids are not ready for testing in a spectrometer, as least not on an ongoing, commercial basis.

In the illustrative embodiment, oligonucleotides are added to the fracking liquid to serve as the tracer material. In order to gather useful information in the testing process, the testing equipment needs to accurately measure minute concentrations of these materials. Additionally, these materials must survive the harsh down-hole environment. Tests conducted in developing this disclosure indicated that oligonucleotides do endure the down-hole environment and are useful for tracing fracking liquid. Oligonucleotides are short, single-stranded DNA or RNA molecules. They are typically manufactured in the laboratory by solid-phase chemical synthesis. These small bits of nucleic acids can be manufactured with any user-specified sequence. The number of potential sequences is very large. The number of sequences is four to the power of N, where N is the length of the sequence. The length of the sequence can range from 2 to 150, which equates to tens of thousands of discrete and unique oligonucleotide sequences. Each sequence has a discrete atomic mass, which is what is measured to identify unique sequences. The range of molecular weights for these oligonucleotides is from 3000 to 6500 atomic mass units.

As was noted hereinbefore, the oligonucleotides contemplated in the illustrative embodiment are DNA, RNA, and LNA. LNA is an acronym for locked nucleic acid. LNA is also referred to as inaccessible RNA, and is a modified RNA nucleotide. During synthesis, the ribose moiety of an LNA nucleotide is modified with an extra bridge connecting the 2' oxygen and 4' carbon. The bridge "locks" the ribose. The locked ribose conformation enhances base stacking and backbone pre-organization. This significantly increases the melting temperature of oligonucleotides, making them more tolerant in the down-hole environment. With respect to down-hole durability of these oligonucleotides, testing indicates that LNA is most durable, then RNA, and then DNA. However, DNA can be utilized down-hole and show good durability. Tests establish that DNA is thermally stable to 1000 degrees, and will not shear under wellbore pressures to at least 7700 PSI. It is expected that DNA can out-survive casing static pressure limits of 20,000 psi. The highest risk to the integrity of the DNA molecules are enzymes called DNAase. However, test samples showed that only the DNA samples sent down hole were detected in well fluid, with no byproducts from DNAase. Furthermore, testing with certain mass spectrometer test methodologies showed that DNA could be reliably detected after exposure to the down-hole environment. DNA is highly tolerant to temperatures seen down-hole, and also tolerant to a wide range of pH. While very low pH for extended periods of time can damage DNA, the down-hole environment is usually not that acidic. The down-hole pH may be in the 5-6 range, with pH of 4 being a practical low limit for acidity. However, DNA can tolerate a pH of 3 for reasonable periods of time. It would take long-term exposure to damage oligonucleotides at such pH levels.

Having established that oligonucleotides are suitable for tracing fracking liquids in real-world down-hole environments and time frames, the next hurdle to their application is recovery and testing for minute concentrations present in well fluids. Since the oligonucleotides would be destroyed by flame (gas chromatograph), the testing procedure must use a non-flame type of mass spectrometer. In the illustrative embodiment, a matrix-assisted laser desorption/ionization source with a time-of-flight mass analyzer (MALDI-TOF) mass spectrometer is utilized. This instrument tests a dry sample, so it is necessary to reduce and concentrate the well fluid sample in order to conduct the measurements of oligonucleotide concentrations. A MALDI-TOF mass spectrometer is accurate to +/−0.2%, and can readily distinguish the oligonucleotide sequences discussed herein. The output of MALDI-TOF is spectrograph style graphic, where the horizontal line distinguishes individual oligonucleotide masses and the vertical amplitude indicates the total mass of each oligonucleotide in a given test run. This data can, or course, be quantified for analysis and incorporation in the test results for the well operator.

The challenge of isolating the oligonucleotides from the other well fluid materials is addressed by biotinylation. This simplifies the recovery of the oligonucleotide in the well fluid samples and increases the overall sensitivity of the testing processes. This is accomplished by biotinylating the 5'-end of the sequence of the oligonucleotides before they are added to the fracking liquid and pumped down-hole. Biotinylation takes advantage of the fact that biotin and avidin or streptavidin (hereafter collectively referred to as "avidin") form the strongest non-covalent bond known in nature with a dissociation constant of greater than ten to the minus fifteenth power. Once the well fluid samples are collected, they are infused with magnetic particles that have avidin immobilized onto their surfaces. Of course the biotinylated oligonucleotides and avidin coated magnetic particles are strongly attracted to one another. This attraction is facilitated by agitating the mixture for a period of time to insure that substantially all of the biotin and avidin have bonded, and therefore assuring that all of the oligonucleotides have been attached to the magnetic particles.

After agitating the sample for a given period to ensure that the biotinylated oligonucleotide has had sufficient opportunity to physically contact the avidin (or streptavidin) magnetic particles, a polar magnet is inserted into the sample, which easily gathers all of the magnetic particles that have the oligonucleotides bonded to them. The magnetic particles are washed to removed well fluid residue, and further washed to collect the magnetic particles from the magnet. The magnetic particles are collected in a small volume allowing for subsequent washing with deionized water to remove any residual components from the sample solution. The magnetic particles are then ready for further preparation for analysis by, preferably, a delayed-extraction (DE) matrix-assisted laser desorption/ionization (MALDI) time-of-flight (TOF) mass spectrometer.

With respect to suitable sample sizes and test concentrations, tracers are added to the fracking liquid with a concentration in the range of one to five parts per million. The sample taken from the well fluid flow may be in the range from four ounces to one gallon, which is concentrated, dried, and then measured with a DE-MALDI-TOF mass spectrometer. Sample concentrations of eight parts per billion are reliably detected, and concentrations below one part per billion can be detected through the foregoing process. Further, the MALDI-TOF mass spectrometer can measure thresholds as low as one part per trillion.

Further testing has indicated that while substantial portions of the oligonucleotides do survive the down-hole environment, there was significant damage to a fraction of them. While it is possible to calibrate the concentration and volumetric calculations to account for such damage losses, there may be a loss of accuracy due to the inconsistent nature and unpredictability of such damage. Accordingly, certain techniques of protecting the oligonucleotides (now referred to collectively as "DNA") have been investigated. Ideally, a protection mechanism would isolate the DNA from chemical and thermal attacks. It is known that fossilized DNA has survived exposure over many years, and such natural protection mechanisms were investigated. Interestingly, there has been research on thermal protection conducted in the area of using DNA to encode plastics parts, relying on the unique DNA sequences as a technique for precise bar-coding.

Paunescu et al. have researched the use of silica encapsulation for protection of DNA published in a paper; D. Paunescu, R. Fuhrer, R. N. Grass, *Protection and Deprotection of DNA—High-Temperature Stability of Nucleic Acid Barcodes for Polymer Labeling, Angew. Chem. Int. Ed.* (2013), 52, 4269-4272. It was noted that nucleic acids are sensitive to harsh environmental conditions and elevated temperatures, which is a fair statement of the down-hole well environment, even though Paunescu et al. never contemplated such an application. The vulnerability of nucleic acids to hydrolysis, oxidation, and alkylation requires well controlled DNA storage and handling conditions, ideally dry and at low temperatures. It was noted that viable ancient DNA, which has been recovered from permafrost samples, or in desiccated form from amber and from avian eggshell fossils, have been discovered and successfully analyzed. Within these fossils a dense diffusion layer of polymerized terpenes or calcium carbonate separates the desiccated DNA specimen from the environment, water, and reactive oxygen species. This is exemplary of how DNA can be protected from harsh environments even in very long-term exposure scenarios. And, this demonstrates the likelihood that encapsulation of DNA within silica particles can mimic these fossils and protect DNA from aggressive environmental conditions. Such a procedure makes DNA processable at conditions well beyond ordinary biological systems. Furthermore, it was noted that testing indicates that silicate and hydrofluoric acid chemistry is compatible with nucleic acid analysis by means of quantitative real-time polymerase chain reaction (qPCR). It has also been determined that silica-protected DNA can readily survive temperatures of at least 200° C., which is sufficiently high for use in down-hole oilfield applications.

Silica is well known as a material with high chemical and thermal stability as well as having excellent barrier properties and can be synthesized at room temperature by the polycondensation of tetraethoxysilane (TEOS). The incompatibility of TEOS and nucleic acid chemistry, both carrying negative charges under reaction conditions, has been previously solved by the introduction of co-interacting species, such as positively charged amino-silanes, directing the growth of amorphous silica to the surface of the DNA double helix.

In an encapsulation approach described by Paunescu et al., a standard DNA ladder was first adsorbed to the surface of submicron-sized silica particles having a diameter of 150 nm, carrying ammonium surface functionalities. In subsequent steps, a silica layer was grown on the nucleic acid decorated surface utilizing N-trimethoxysilylpropyl-N,N,N-trimethylammonium chloride (TMAPS) as co-interacting species and TEOS as silicon source. Although silica surface growth is usually performed under acid or base catalysis, neutral conditions can be employed to prevent the hydrolysis of DNA. Furthermore, it is possible to dissolve the DNA/$SiO_2$ particles rapidly in a buffered HF/$NH_4$ solution. For the present disclosure, the submicron-sized silica core particles are replaced with a magnetic core, such as a submicron-sized magnetite, which facilitates the purification and concentration techniques desirable for efficient and reliable concentration testing.

The encapsulation of DNA in silica has been previously investigated for the formation of complex-shaped nanocomposites, however, only if the DNA can be released from the glass spheres unharmed can the stored information be utilized. While silica is unaffected by most chemical reactants at room temperature, it dissolves quickly in hydrofluoric acid (HF) through the formation of hexa-fluorosilicate ions. Hydrofluoric acid is known as a highly toxic chemical, however, aqueous hydrofluoric acid is a relatively weak acid and does not significantly damage nucleic acids. DNA/$SiO_2$ particles can be rapidly dissolved in buffered oxide etch (HF/$NH_4F$, a buffered HF solution). The combination of protected nucleic acids and ultrasensitive biochemical analysis by qPCR or MALDI-TOF makes it possible to prepare chemically stable tracer particles, carrying unique codes with very low detection limits.

Figure 5:
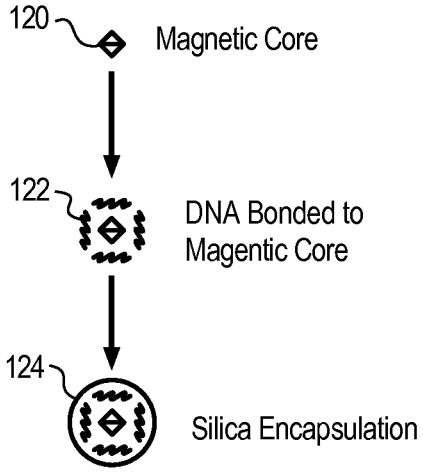
FIG. 5 is a particle fabrication diagram according to an illustrative embodiment of the present invention.

Reference is directed to FIG. 5, which is a particle fabrication diagram according to an illustrative embodiment of the present invention. A magnetic core particle 120 has a unique sequence of DNA 122 bonded to its surface using a suitable bonding technology, as are known to those skilled in the art. Specific examples will be discussed hereinafter. The bonded core and DNA are subsequently encapsulated with silica 124, thereby protecting the DNA from the chemicals, pressure, and temperature that are present in a down-hole hydrocarbon well environment. Magnetic core materials are generally the ferrous compounds, and in the illustrative embodiment, magnetite is utilized. Submicron-sized particles ranging from 10 to 200 nm are generally suitable, although other sizes may be employed. Once the silica-encapsulated particles 124 are prepared, they are employed from the fracture liquid tracing as discussed hereinbefore.

Figure 6:
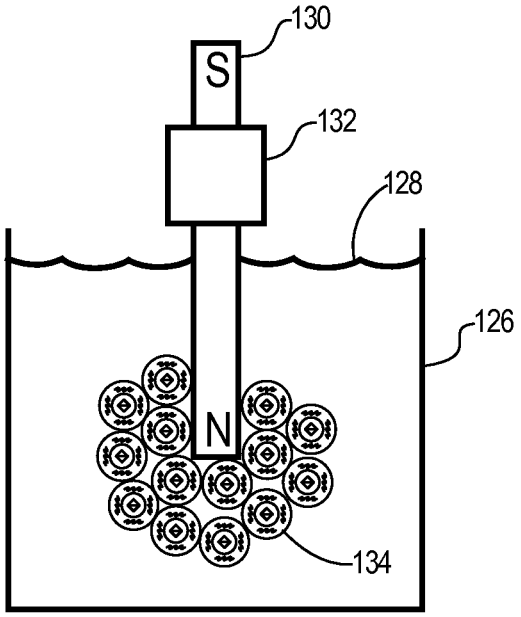
FIG. 6 is a separation process diagram according to an illustrative embodiment of the present invention.

Reference is directed to FIG. 6, which is a separation process diagram according to an illustrative embodiment of the present invention. After the DNA tracing materials have been blended with the fracking liquid, pumped down hole, and then recovered during the time the fracking liquids are pumped out of the well, plural samples are taken at the wellhead, and they are individually contained in a suitable container, such as an eight ounce glass or plastic jar. The first step is to insert a polar magnet 130 in the jar 126 that contains an individual raw well fluid 128 sample. In this embodiment, an electromagnet is employed so there is an electric coil 132 that is energized to generate magnetic lines of flux, which draw the encapsulated particles 134 by magnetic attraction. Some agitation is beneficial to ensure that most of the particles 134 are adhered to the magnet 130. Various magnet configurations may be employed, including multi-pole, permanent, and electromagnets. Once the particles 134 are adhered to the magnet 130, the magnet is withdraw from the well fluids 128 to remove and concentrate the particles. An ionized water rinse may be employed for additional cleansing. The magnet and particles are then placed into a diluted hydrofluoric (HF) acid solution, as shown in FIG. 7.

Figure 7:
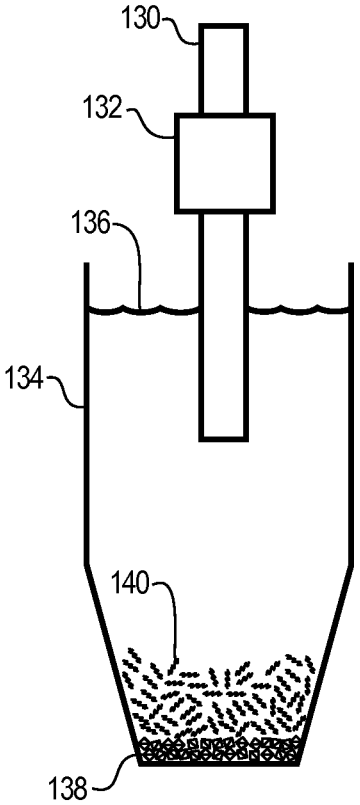
FIG. 7 is a concentration process diagram according to an illustrative embodiment of the present invention.

Reference is directed to FIG. 7, which is a concentration process diagram according to an illustrative embodiment of the present invention. A centrifuge vial 134 that contains an HF acid solution 136, such as in a buffered HF/$NH_4$ solution, as are known to those skilled in the art. The magnet 130 and coil 132 are submerged into the solution 136 and coil 132 is deenergized, to release the particles. Note the some agitation is employed to circulate the solution 136, start dissolving the silica, and rinse the particles off of the magnet 132. As the silica is dissolved away, the magnetic core particles 138 precipitated to the bottom of the vial 134 and the DNA 140 goes into solution. The vial 134 is inserted into a centrifuge to accelerate the separation. Some of the liquid 136 may be decanted off the vial 134 to further concentrate the sample. The magnetic particles 138 may also be removed by magnetic attraction, such as by placing a magnet under the vial 134 as the DNA 140 laden liquid 136 is poured off. Again, some rinsing and neutralizing agents may be employed to clean the DNA sample prior to analysis using qPCR or MALDI-TOF, as discussed hereinbefore.

Figure 8:
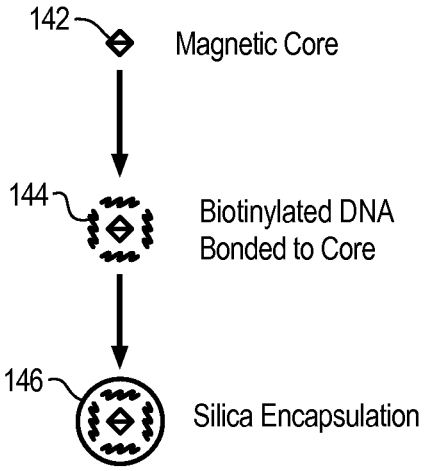
FIG. 8 is a particle fabrication diagram according to an illustrative embodiment of the present invention.

Reference is directed to FIG. 8, which is a particle fabrication diagram according to an illustrative embodiment of the present invention. In this embodiment, the biotin/avidin non-covalent bond, which was introduced hereinbefore, is advantageously utilized to concentrate the DNA sample prior to analysis by qPCR or MALDI-TOF. A magnetic core 142 has biotinylated DNA bonded to its surface using a suitable bonding technique, and then the DNA/magnetic core is silica encapsulated 146. These particles 146 are used to trace fracking liquid, and are then recovered in a sample, as has been discussed hereinbefore.

Figure 9:
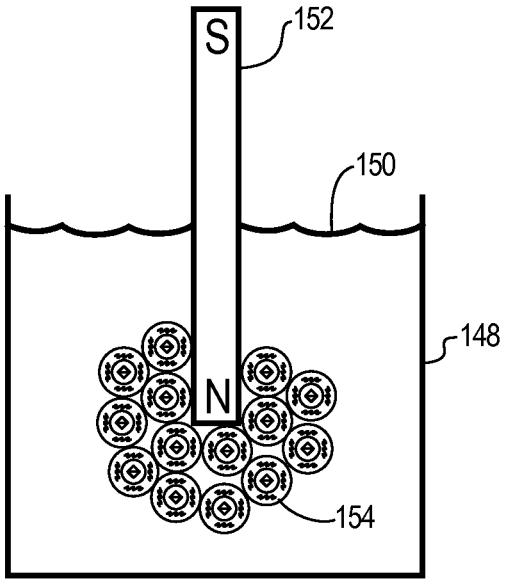
FIG. 9 is a separation process diagram according to an illustrative embodiment of the present invention.

Reference is directed to FIG. 9, which is a separation process diagram according to an illustrative embodiment of the present invention. FIG. 9 follows FIG. 8. In FIG. 9, the raw well fluid sample 150 is contained in a sample vessel 148, and a polar magnet 152 is inserted into the well fluid 150 to gather the silica encapsulated tracer particles 154, by virtue of the aforementioned magnetic cores in the various particles. Agitation may be employed to improve the recovery efficiency of the magnet 152. The magnet 152 is then withdrawn from the well fluid 150 to recover the particles 154 therefrom. The particles may then be rinsed to further refine the recovered sample particles.

Figure 10:
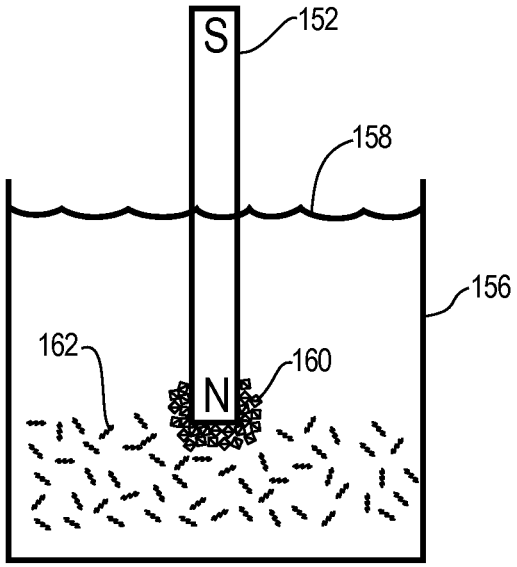
FIG. 10 is a separation process diagram according to an illustrative embodiment of the present invention.

Reference is directed to FIG. 10, which is a separation process diagram according to an illustrative embodiment of the present invention. In this figure, the polar magnet 152 from FIG. 9 is inserted into an HF acid solution 158 to dissolve away the silica from the particles. The magnetic cores 160 remained adhered to the magnet 152 while the DNA 162 goes into solution. Again, agitation is used to facilitate the dissolution of the silica. The magnet 152 is then withdrawn from the HF solution 158, leaving the DNA 162 behind. The next step is to utilize the biotin/avidin bonding affinity to recover the DNA 162 and further concentrate the sample prior to analysis.

Figure 11:
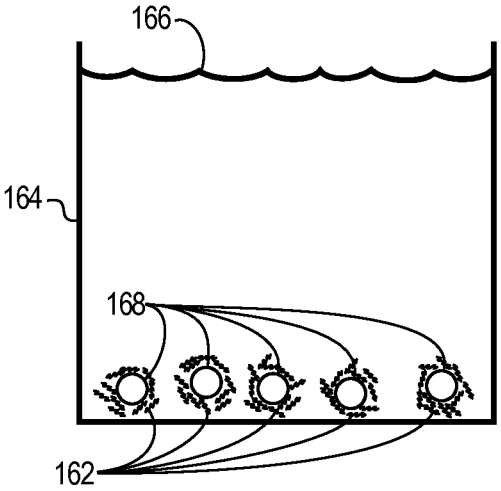
FIG. 11 is a concentration process diagram according to an illustrative embodiment of the present invention.

Reference is directed to FIG. 11, which is a concentration process diagram according to an illustrative embodiment of the present invention. In this step, magnetic beads 168, which have an avidin or streptavidin compound bonded to their surfaces (hereinafter "avidin beads"), are immersed into the sample liquid 166. Note that this liquid may still be the HF solution 158 from FIG. 10, or there may have been some further rinsing or chemical processes employed. At any rate, in FIG. 11, the DNA in solution is drawn to the avidin beads 168. The liquid 166 can then be decanted or filtered off the avidin beads 168 with the DNA bonded thereto. The next step is to cleave-off the DNA from the avidin beads 168 using a suitable cleaning agent.

With respect to the selection of the biotinylation and cleaving compounds, there are many commercially available biotinylation kits that enable simple and efficient biotin labeling of antibodies, proteins and peptides. The biotin is bound to the ends of the DNA molecules and later immobilize onto the avidin beads 168. The beads 168 are gathered and isolated using magnetic separation. The next step is to elute off the DNA for characterization. A dual biotin with two biotin molecules in sequence can increase binding strength with streptavidin. This helps to keep biotinylated DNA on the beads during heating at higher temperatures. The streptavidin-biotin interaction is the strongest known non-covalent, biological interaction between a protein and ligand. The bond formation between biotin and streptavidin is very rapid and, once formed, is unaffected by wide extremes of pH, temperature, organic solvents and other denaturing agents. Hence, often very harsh methods are required to dissociate the biotin from streptavidin, which will leave the streptavidin adversely denatured. Using derivative forms of biotin allow for a gentle way of dissociation of biotin from streptavidin. Several cleavable or reversible biotinylation reagents allow specific elution of the biotinylated molecule from streptavidin in a gentle way.

Biotinylation with cleavable reagents can be done in different ways, and the selection of a suitable methodology for down-hole application warrants some empirical evaluation. The first option is enzymatic incorporation of a biotin dUTP analogue with a cleavable linker. Incorporation of a biotin with a linker arm containing a disulphide bond allows for a simple dissociation of the DNA fragment, as the disulphide links easily become cleaved with dithiothreitol. This reagent is enzymatically incorporated into a DNA fragment either by end-labeling, nick translation or mixed primer labeling. Another cleavable reagent is by chemical incorporation of the guanido analogue of NHS biotin. III. Chemically biotinylation of proteins using a biotin-X-NHS-Ester. Another option is Chemically biotinylation of DNA using biotin-X-NHS-Ester. NHS-biotin contains a cleavable disulphide bond so the desired DNA can be easily cleaved from the biotin/streptavidin complex. Thiol-cleavable NHS-activated biotins react efficiently with primary amine groups in pH 7-9 buffers to form stable amide bonds. Another option is DSB-XTM Biotin Protein Labeling. This approach provides a method for efficiently labeling small amounts of DNA the unique DSB-X. biotin ligand. DSB-X biotin is a derivative of desthiobiotin. a stable biotin precursor that has the ability to bind biotin-binding proteins, such as streptavidin and avidin. Whereas harsh chaotropic agents and low pH are required to dissociate the stable complexes formed between biotin and streptavidin or avidin, DSB-X biotin can be readily displaced by applying an excess of D-biotin or D-desthiobiotin at room temperature and neutral pH.

Figure 12:
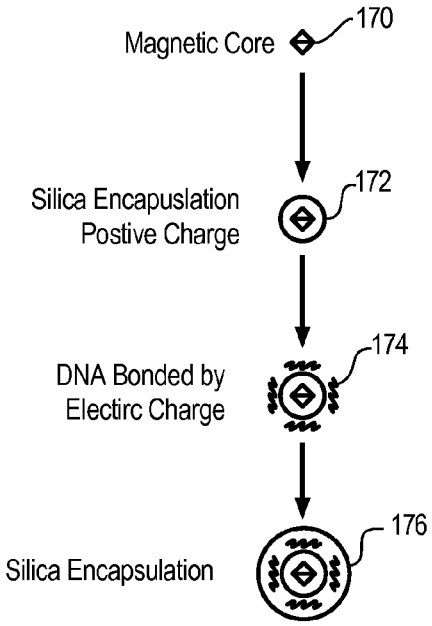
FIG. 12 is a particle fabrication diagram according to an illustrative embodiment of the present invention.

Reference is directed to FIG. 12, which is a particle fabrication diagram according to an illustrative embodiment of the present invention. This embodiment employs an electric charge attraction between the magnetic core 170 and the DNA 174 through utilization of a first silica encapsulation 172 that is treated to establish a positive charge to compliment the natural negative charge of DNA. The magnetic core 170 is magnetite in the illustrative embodiment, which is encapsulated with a first layer of silica 172. The first silica encapsulation is treated with positively charged amino-silanes, rendering a positive charge. The positive charge attracts the DNA 174 by virtue of the natural negative charge that DNA possesses. The particle is then encapsulated with second silica layer 176, which serves to protect the DNA from exposure in the down-hole and well fluid environments.

Figure 13:
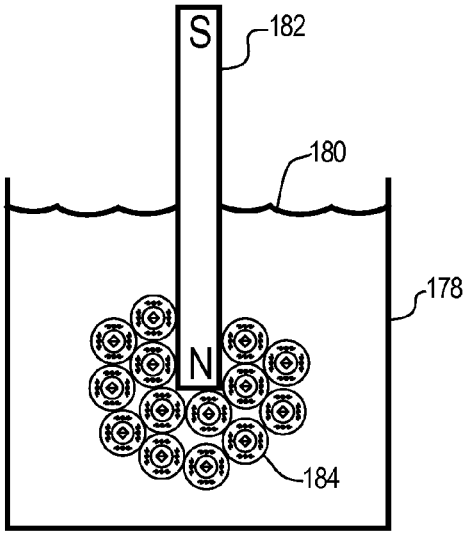
FIG. 13 separation process diagram is a according to an illustrative embodiment of the present invention.

Reference is directed to FIG. 13, which is separation process diagram according to an illustrative embodiment of the present invention. With the particle fabrication complete, the DNA is used to trace fracking liquids in the well and recovered with the raw well fluids 180. The sample is held in a sample container 178. A magnet 182 is used to gather the particles 184, which contain particles from potentially all of the unique tracers utilized in the fracking job. The particles 184 are removed form the well fluid 180 using the magnet 182, as was described hereinbefore.

Figure 14:
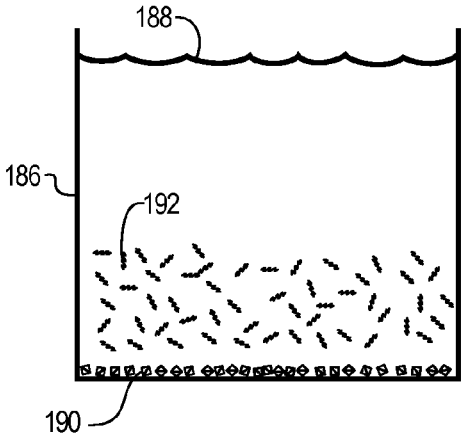
FIG. 14 is a concentration process diagram according to an illustrative embodiment of the present invention.

Reference is directed to FIG. 14, which is a concentration process diagram according to an illustrative embodiment of the present invention. The particles 184 from FIG. 13 are rinsed off into a second container 190 using ionized water 188 in FIG. 14. The second container 186 contains a dilute HF acid solution that dissolves both the first and second silica layers. This action eliminates the positive charge on the magnetite 190, which is free to settle either by gravity of centrifugal force, leaving the DNA 192 in solution. Alternatively, a second magnet can be used to remove the magnetite 190 from the HF 188. The DNA 192 is then concentrated and measured in the matters described hereinbefore.

Figure 15:
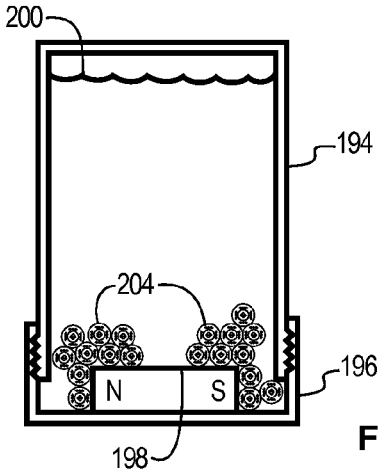
FIG. 15 is a separation process apparatus drawing according to an illustrative embodiment of the present invention.

Reference is directed to FIG. 15, which is a separation process apparatus drawing according to an illustrative embodiment of the present invention. As was noted above, agitation is commonly employed to assure that mixtures and bonding actions are sufficiently complete in the foregoing embodiments. Since the well fluid samples must be taken at the oil and gas well sites, they are transported by vehicle to a testing facility. This movement and vibration are advantageously employed to provide the requisite agitation by fixing a magnet 198 to the inside of a lid 196 of the sample vessel 194. The vessel is inverted during transport to assure that the magnet 198 is flooded with the well fluid samples 200. This provides the time and movement to fully adhere substantially all of the sample particles 204 to the magnet 198 upon arrival at the testing facility.

Figure 16:
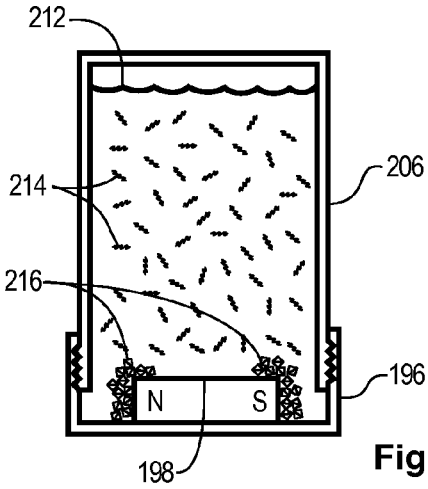
FIG. 16 is a separation process apparatus drawing according to an illustrative embodiment of the present invention.

Reference is directed to FIG. 16, which is a separation process apparatus drawing according to an illustrative embodiment of the present invention. This figure illustrates a further advantage of the magnet 198 in the lid 196 of the sample vessel. The lid is removed from the sample vessel 194 of FIG. 15 and placed onto a process vessel 206 that is filled with dilute HF acid. Naturally, the particles 204 transfer with the magnet, and then the silica dissolves in the HF acid 212 in the process vessel 206. The magnetite cores 216 remain adhered to the magnet 198 and the DNA samples 214 go into solution in the liquid 212. Subsequent processing the measurements are then applied, as described hereinbefore.

Research and testing has shown that specific particle, core, and encapsulation materials and techniques can improve the performance of the tracing particle technology within the hydrocarbon well environment. Particularly the silicon based compounds utilized in the fabrication of the tracer particles. As described hereinafter, "silicon oxide" will be used in this Specification and the appended Claims to refer to amorphous oxide of silicon that may or may not be stoichiometric. A stoichiometric silicon oxide ($SiO_2$) comprises a three-dimensional network of tetrahedrally coordinated silicon atoms (i.e., coordinated by four oxygen atoms), while a sub-stoichiometric silicon oxide (SiOx) comprises a three-dimensional network where silicon atoms are coordinated by less than four oxygen atoms. A "silicon oxide" thusly refers to an oxide of silicon that can be represented by a chemical formula $SiO_x$, where x is 2 or less. Furthermore, it will be understood that a "silicon oxide" can have some other atoms incorporated therein, such as, for example, hydrogen (H), carbon (C), nitrogen (N), and sulfur (S), or aluminum (Al), among other impurities. When aluminum is incorporated into silicon oxide, at least some aluminum atoms can replace the silicon atoms of silicon oxide. As used herein in this Specification and the appended Claims, such silicon oxide having aluminum atoms incorporated therein is referred to as "aluminum silicate", and also aluminum-containing silicon oxide, or aluminum-incorporated silicon oxide.

The inventors have determined that incorporating aluminum atoms into the molecular network of silicon oxide cores and shells of tracer particles substantially increases their stability in aqueous solutions as compared to silicon oxide materials that do not contain aluminum oxides. The increased stability is useful for enhancing the physical properties of the particle shell when exposed to aqueous or high humidity environments, and particularly hydrocarbon well fluids, which contain a substantial mount of water. The stable shell surface allows for long term encapsulation of other particles, including ferromagnetic particles, DNA (oligonucleotides), and nanoparticles in general. Certain compounds remain bound to the surface of aluminum stabilized silicon oxide shells for extended periods of time, which increases the shelf life of aluminum silicate shelled particles. The core-shell particles may be used for certain processes and purposes, including hydrocarbon well fluid tracing compounds, while the aluminum silicate shell provides the stability and protection from detrimental exposure, including hydrocarbon well down-hole exposure. The aluminum silicate shell has increased stability in water compared to silicon oxide shells without aluminum. The stable shell surface allows for long term exposure of encapsulated DNA (oligonucleotides), magnetic particles, and nanoparticles, which is beneficial for fracking fluid tracing in real-world down-hole environments.

Figure 17:
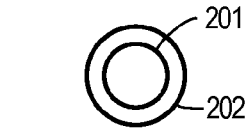
FIG. 17 is a schematic cross-sectional view of a tracer particle according to an illustrative embodiment of the present invention.

Reference is directed to FIG. 17, which is a schematic cross-sectional view of a tracer particle 200 fabricated using silicon-based materials according to some illustrative embodiments of the present invention. The particle 200 comprises a core 201 and a shell 202. The core 201 may, or may not, comprise a silicon-based material. The shell 202 does comprise silicon oxide and/or aluminum silicate, as those terms are defined herein. One function of the shell 202 is to protect the core 201 and tracing compounds, which are oligonucleotides in several illustrative embodiments. Another function of the shell may be to contain an oligonucleotide tracing material. Thus, a tracing particle comprises a core portion that is protected by a shell portion. As described herein, a core of a particle having a core-shell structure refers to an inner portion that does not surround another portion of the particle. Furthermore, a shell of a particle having a core-shell structure refers to an outer portion that surrounds another portion, which can be a core, but can also be another shell surrounding the core. This arrangement contemplates a particle with plural shells disposed about a single core. For example, there may be a silicon oxide inner shell and an aluminum silicate outer shell. In such a case, the two shells may be referred to simply as the shell surrounding a core.

In a particular illustrative embodiment, the shell 202 comprises at least one atomic element not included in the core, which may be aluminum. The cores 201 in an illustrative embodiment are characterized by a median diameter useful in the range from 20 nm to 100 nm, although other sizes may be suitable depending on the nature of the magnetic material utilized. It is significant to note that the finished particle 202 needs to remain in suspension, such as by colloidal action, in order to be useful as a tracer.

Figure 18:
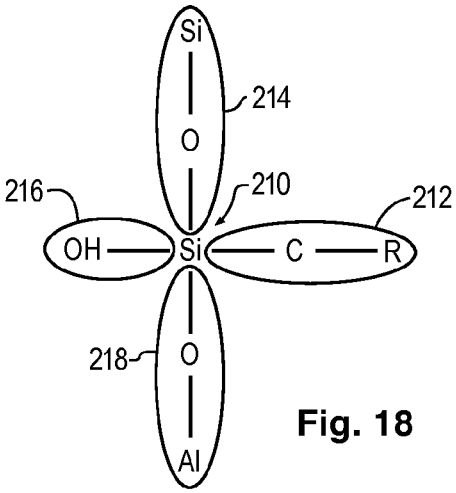
FIG. 18 is a schematic representation of certain functional atomic groups that can be linked to a silicon atom according to an illustrative embodiment of the present invention.

Reference is directed to FIG. 18, which is a schematic representation of certain functional groups that can be linked to a silicon atom 210 within a particle core or a particle shell, according to an illustrative embodiment. A silicate shell includes a three dimensional network of silicon atoms where a silicon atom is connected by at least one oxygen atom to another silicon atom. An aluminum silicate shell is a three dimensional network of silicon and aluminum atoms where a silicon atom or an aluminum atom is connected by at least one oxygen atom to another silicon or aluminum atom. Each silicon atom can have up to four bonds. Bonds can connect to another silicon or aluminum atom through an oxygen bridge, bonds can connect to OH— groups, and bonds can connect to organic groups connected to the silicon via a carbon.

FIG. 18 schematically shows 4 types of functional groups, also referred to herein as molecular units or moieties that can bind to a silicon atom 210 in the three dimensional network of an aluminum silicate shell according to an illustrative embodiment of the present invention. While the four functional groups 212, 214, 216 and 218 are illustrated as being bound to a common silicon atom 210, such representation is for illustrative purposes only, and an actual aluminum silicate shell can have anywhere from zero to four of any one of the four functional groups 212, 214, 216 and 218 bound to any individual atom. The first functional group 212 is a representation of the binding of a silicon atom 210 to a carbon atom that is linked to an organic molecule, R. The second functional group 214 is a representation of the binding of a silicon atom 210 to another silicon atom through an oxygen atom. The third functional group 216 is a representation of the binding of a silicon atom 210 to a hydroxyl group. The fourth functional group 218 is a representation of the binding of a silicon atom 210 to an aluminum atom via an oxygen atom. In an illustrative embodiment, the average number of 212 and 214 linkages for all of the silicon atoms in the aluminum silicate shell is at least 1. In an illustrative embodiment, the average number of hydroxyl groups 216 connected to the silicon atoms in the aluminum silicate is useful in the average range between 0.001 and 2 per silicon atom. In another embodiment, the percentage of the moieties that are bound to silicon atoms that consist of hydroxyl groups is useful if less than 50%.

Further considering FIG. 18, in an illustrative embodiment, the silicon moieties in the aluminum silicate shell arise from the hydrolysis of mixtures containing one or more silicon containing species of the form $Si(OR1)_dR2_e$, where d>1, e<3, d+e=4, and e can be zero, and OR1 is an alkoxide, and R2 is an alkyl chain with a direct C—Si bond that may or may not have other atoms other than carbon or hydrogen present. Specific examples of silicate precursors of this type include but are not limited to tetraalkoxysilane such as tetraethoxysilane or tetramethoxysilane; and a trialkoxysilane compound such as methyltrimethoxysilane, methyltriethoxysilane and phenyltriethoxysilane, mercaptopropyltriethoxysilane and aminopropyltriethoxysilane.

With respect to chemical development and testing, in order to characterize the elemental composition of the core and shell particles, ICP-MS (Inductively Coupled Plasma Mass Spectrometry) or other elemental analysis can be employed. By utilizing the porosity of the shell and the differential solubilities of the various components of the particle it is possible to dissolve out the component of interest and independently determine its elemental composition. Silicon oxide-based materials can be dissolved in HF solutions while most other materials are inert to HF. In addition, silicon oxide and aluminum silicate materials are resistant to acid solutions while many core materials (e.g. some metals and many metal oxides) are converted to soluble species suitable for analysis by ICP-MS by exposure to acids such as nitric acid or hydrochloric acid. For particles that comprise polymers, organic solvents may selectively dissolve the polymer (e.g. polystyrene can be dissolved with tetrahydrofuran). Separation of the soluble from insoluble components can be performed by techniques such as centrifugation or filtration to allow for independent analysis of the different components. In some embodiments, these techniques can be utilized to determine the relative percentages of silicon oxide or aluminum in the shell or the amount of metal present in the core.

Referring back to FIG. 17, in the illustrative embodiment, the core 201 of the particle comprises a material that can be a single element or a combination of elements. The core material may include a ferromagnetic or a super paramagnetic material in the case of tracing particles subject to the aforementioned magnetic separation techniques. Metals utilized for the core in the illustrative embodiment may include iron, nickel, cobalt, neodymium, aluminum, platinum, boron, yttrium, oxides of these materials, or mixtures and compounds of these metals, including ferrites and magnetite. Alloys of these metals are also contemplated.

In various illustrative embodiments of particles having a core and one or more shell layers, some of which are contemplated in FIGS. 19 through 27, the particles incorporate various functional entities within the particles. As used herein, a functional entity generally refers to atoms, molecules, clusters, nanoparticles or combinations thereof that can impart various functionalities to the particles, which for the tracing compound particles comprise magnetic materials and oligonucleotide materials, which may be generally referred t as DNA. Furthermore, in certain illustrative embodiments, such functional entities may be a superparamagnetic entity, a paramagnetic entity or a ferromagnetic entity.

In the illustrative embodiments, various entities and particles incorporating the same are described. In one illustrative embodiment, two or more nanoparticles are incorporated within each particle. In another illustrative embodiment, magnetic nanoparticles, are incorporated within each particle. In another illustrative embodiment superparamagnetic, paramagnetic or ferromagnetic nanoparticles are incorporated within each particle. In another illustrative embodiment various ranges of quantities of nanoparticles are incorporated in each particle, which may range from 1 to 10,000.

Figure 19:
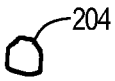
FIG. 19 is a drawing of a particle core according to an illustrative embodiment of the present invention.

Reference is directed to FIG. 19, which is a drawing of a core 204 according to an illustrative embodiment of the present invention. This embodiment provides a single particle of a magnetic material for use as the core 204. In certain illustrative embodiments, these may be ferromagnetic or superparamagnetic materials. This corresponds to previously disclosed embodiments presented respecting FIGS. 5, 8 and 12. The magnetic material may be selected from those suitable for the magnetic separation techniques presented with respect to FIGS. 6, 9, and 13. In illustrative embodiments, iron, cobalt, and nickel, as well as compounds and oxides thereof provide adequate performance. However, rare earth compounds and Heusler alloys can also be employed. The single particle 204 may be crystalline or amorphous in form.

Figure 20:
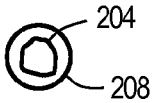
FIG. 20 is a drawing of a fracking fluid tracer particle according to an illustrative embodiment of the present invention.

Reference is directed to FIG. 20, which is a drawing of a fracking fluid tracer particle 206 comprising a core 204 and a shell 208 according to an illustrative embodiment of the present invention. This embodiment is consistent with the embodiment of FIG. 19, wherein the ferromagnetic particle 204 has a silicon oxide or aluminum silicate shell 208 deposited about it. Note that this is presented as a generic particle 206, where the specific oligonucleotide (DNA) functional element is not illustrated, although, its incorporation into the particle 206 would be required in order to achieve the desired tracing capability. The attachment, coating, embedding, and/or encapsulation are discussed elsewhere in this disclosure. Note also that the shell portion 208 may comprise both a silicon oxide and aluminum silicate layer, which can be deposited one upon the other, where placing the aluminum silicate layer on the outermost portion is beneficial to protect the inner portions of the particle 206.

Figure 21:
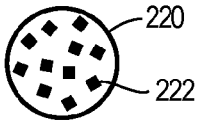
FIG. 21 is a schematic cross-sectional view of a particle core according to an illustrative embodiment of the present invention.

Reference is directed to FIG. 21, which is a schematic cross-sectional view of a particle core 220 that includes dispersed functional entities therein, according to an illustrative embodiment of the present invention. In the illustrated embodiment, two or more nanoparticles 222 are incorporated within the core 220 of a particle and are separated from adjacent nanoparticles by the core material. In an illustrative embodiment, the core nanoparticles 222 are magnetic materials. In another illustrative embodiment, the particles 222 comprise magnetic particles and oligonucleotide particles. It is useful for the magnetic particles to constitute a 50% or greater portion of the core total. In an illustrative embodiment, the core 220 material is a silicon oxide.

Figure 22:
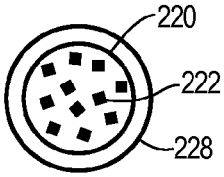
FIG. 22 is a schematic cross-sectional view of the particle core according to an illustrative embodiment of the present invention.

Reference is directed to FIG. 22, which is a schematic cross-sectional view of the particle core 220 of FIG. 21, and which has been encapsulated with a shell 228, according to an illustrative embodiment. In FIG. 22, the core 220 having nanoparticles 222 dispersed therein is encapsulated by an aluminum silicate shell 228. In some illustrative embodiments, the nanoparticles 222 are uniformly dispersed throughout each particle. Oligonucleotide particles may be dispersed within the shell layer in some illustrative embodiments.

Figure 23:
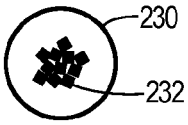
FIG. 23 is a schematic cross-sectional view of a particle core according to an illustrative embodiment of the present invention.

Reference is directed to FIG. 23, which is a schematic cross-sectional view of a particle core 230 that includes aggregated nanoparticles 232, according to an illustrative embodiment of the present invention. In this embodiment, a cluster of nanoparticles 232 is encapsulated within a core 230. In an illustrative embodiment, the nanoparticles 232 are ferromagnetic particles. In another illustrative embodiment, the particles 232 comprise ferromagnetic particles and oligonucleotide particles. In certain embodiments there are a quantity of nanoparticles in the cluster 232 that ranges from 2 to 10,000 nanoparticles. In another embodiment the nanoparticles in the core have an edge-to-edge spacing that is less than 10 nm. In yet another embodiment, at least some of the nanoparticles 232 are in contact with one another. In an illustrative embodiment, the core material is a silicon oxide.

Figure 24:
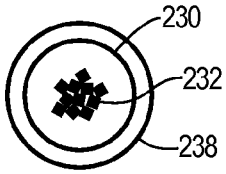
FIG. 24 is a schematic cross-sectional view of a particle core according to an illustrative embodiment of the present invention.

Reference is directed to FIG. 24, which is a schematic cross-sectional view of the particle core 230 of FIG. 23, which has been encapsulated with a shell 238, according to an illustrative embodiment of the present invention. In this embodiment, the core 230 having the nanoparticles 232 encapsulated therein is further encapsulated with an aluminum silicate shell 238. In another illustrative embodiment, the shell 238 has oligonucleotide particles dispersed therein.

In certain illustrative embodiment of the present invention, the functional entities incorporated within particles are magnetic nanoparticles, which are incorporated within the core, or, within one or more shells, or, are bound to the surface of the core or shells. Magnetic nanoparticles have a magnetic response in a magnetic field. In some embodiments, this response may take the form of being attracted to a magnet allowing for separation of the particles from a fluid. In one embodiment, the magnetic nanoparticles are chosen from a group consisting of iron, cobalt, nickel, gadolinium, and dysprosium, and their associated oxides. In another embodiment, the magnetic nanoparticles comprise other elements or combination of elements that are ferromagnetic or super paramagnetic. In another embodiment, the magnetic nanoparticles are comprised of particles with a median diameters that range in size from 20 to 130 nm. In another embodiment, the magnetic nanoparticles have a median size between 5 and 50 nm. In another embodiment, the magnetic nanoparticles are superparamagnetic. In another embodiment the magnetic nanoparticles are comprised of at least 30% of iron oxide of the formula $Fe_3O_4$ or $Fe_2O_3$. In another embodiment, the magnetic nanoparticles have an average magnetic moment of at least 1 emu/g in a field of 20000 Oe.

Figure 25:
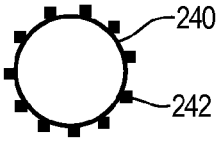
FIG. 25 is a schematic cross-sectional view of a particle core according to an illustrative embodiment of the present invention.
Figure 26:
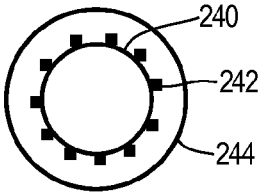
FIG. 26 is a schematic cross-sectional view of a particle according to an illustrative embodiment of the present invention.
Figure 27:
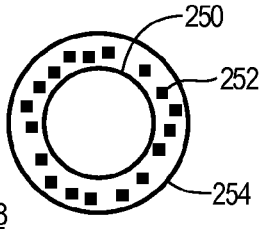
FIG. 27 is a schematic cross-sectional view of a particle according to an illustrative embodiment of the present invention.

Reference is directed to FIGS. 25, 26, and 27, which illustrate certain illustrative embodiments wherein functional entities can be bound to the surface of a core, surface of a shell, or be incorporated within a shell. In certain illustrative embodiments, the functional entities are nanoparticles, magnetic nanoparticles, and/or oligonucleotide particles.

Reference is directed to FIG. 25, which is a schematic cross-sectional view of a particle core 240 having functional entities 242 formed on its surface, according to certain illustrative embodiments of the present invention. In one illustrated embodiment, the core 220 material silicon oxide, aluminum silicate, or other oxide. In certain illustrative embodiments, the binding of the functional entities 242 to the core 240 is electrostatic, covalent, or due to physisorption. In certain illustrative embodiments, the functional entities 242 are oligonucleotides.

Reference is directed to FIG. 26, which is a schematic cross-sectional view of a particle having a core 240, a shell 244 encapsulating the core, and functional entities 242 formed at the core-shell interface, according to an illustrative embodiment of the present invention. In the illustrated embodiment, an aluminum silicate shell 244 encapsulates functional entities 242, which may be oligonucleotides, bound to the surface of the core 240. The core may also comprise a magnetic material.

Reference is directed to FIG. 27, which is a schematic cross-sectional view of a particle having core 250 that is encapsulated within a shell 254 having dispersed functional entities 252 therein, and according to an illustrative embodiment of the present invention. An aluminum silicate shell 254 encapsulates the core 250. In other illustrative embodiments, a silicon oxide shell encapsulates the core. In addition, functional entities 252 are dispersed throughout the shell and, optionally, functional entities 252 may be bound to the surface of the core 250. In one embodiment, the core 250 is a silicon oxide having magnetic material therein. In one embodiment, the functional entities 252 are oligonucleotides. In another embodiment, the shell 254 is a silicon oxide further coated with a layer of aluminum silicate (not shown). In an embodiment, the binding of functional entities 252 to the surface of the core 250 or shell 254 can occur via electrostatic binding or via covalent coupling. Examples of covalent binding chemistry include, but are not limited to, bond formations between carboxylic acid and amine functionalized surfaces, or amine and sulfhydryl surfaces. The shell 254, and outer shell (not shown) can have a useful thickness that is less than 200 nm.

In other embodiments of the present invention, the fracking fluid tracing particles comprises a core and one or more shells where oligonucleotides are incorporated in the core, on the surface of the core, in one or more of the shells, or on the surface of one of more of the shells, and where at least one of the shells is aluminum silicate. In another illustrative embodiment the oligonucleotides are DNA, RNA, or LNA, and are incorporated at a mass percentage in the range of 0.001 to 1% of the mass of the particle. In another embodiment the oligonucleotides are electrostatically bound to the shell. In another embodiment the oligonucleotides are incorporated within the core or the intermediate shell and not the outermost shell. In another embodiment the core or one of the shells contains magnetic nanoparticles and one or more shells contain oligonucleotides.

In an illustrative embodiment of the present invention, the fracking fluid tracing particles consists of a core and one or more shells where oligonucleotides, also referred to as DNA, are incorporated in the core, on the surface of the core, in one or more of the shells, or on the surface of one of more of the shells and where at least one of the shells is aluminum silicate. In another embodiment, the oligonucleotides are DNA, RNA, or LNA and are incorporated at a mass percentage 0.001 to 1% of the mass of the particle. In another embodiment the oligonucleotides are electrostatically bound to the shell. In another embodiment the oligonucleotides are incorporated within the core or the intermediate shell and not the outer shell. In another embodiment, the core or one of the shells contains magnetic nanoparticles and one or more shells contain oligonucleotides. In another embodiment, magnetic aluminum silicate shelled particles contain oligonucleotides with a median length in the range of 6 to 2000 nucleotides. In another embodiment, the oligonucloetide containing particles are released into the environment and then subsequently recovered and analyzed by dissolving the particles, using the polymerase chain reaction and detecting the amplified product of the released oligonucleotides. In another embodiment the oligonucleotide containing particles are fabricated to withstand high temperatures as high as 200° C., in an acidic (pH between 2 and 7) or basic (pH between 8 and 12) environments for up to 20 days where as much as 95% of the oligonucleotides are retained in the particle. In another embodiment, magnetic nucleic acid containing particles are extracted from a liquid or a dissolved solid by using a magnetic field. In another embodiment, an apparatus is utilized that flows the liquid over a magnet where the liquid film has a thickness in the range of 1 to 10 mm. In another embodiment, the oligonucleotides are released from the particle by dissolving the particles in an aqueous fluoride solution.

In an illustrative embodiment of the present invention, a coupling agent is bound to the surface of the metal or metal oxide core particle before the growth of the silicon oxide shell. Coupling agents can include mercaptoundecanoic acid, mercaptoproprionic acid, polyvinylpyrollidone, polyvinyl alcohol, aminopropyltrimethoxy silane, mercaptopropyltrimethoxy silane, or other amino or mercapto containing silanes. In some embodiments, the coupling agent is added at a concentration to provide excess monolayer coverage that may be as high as 10000%, to provide large reserve of ligands. In some embodiments, the core nanoparticles are transferred to an alcohol based solvent. The transfer to a different solvent can occur using centrifugation or tangential flow filtration.

In an illustrative embodiment of the present invention, the tracing particles are coated in solution utilizing precursors including species of the formula $X_nSiY_{(4-n)}$ where $0<n<4$; and X and Y are each independently OEt, OMe, Cl, Br, I, H, alkyl, fluoroalkyl, perfluoroalkyl, alkoxide, aryl, alkyl amine, alkyl thiol or any combination thereof. In another embodiment, the silicon oxide shell is produced using silanes or mixtures of silane molecular units that have the formula $Si(R_{1-4})_4$ where $R_1$, $R_2$, $R_3$, and $R_4$ can be various functional groups include methyl, ethyl, propyl or other alkyl molecules, alkyl amines, alkyl thiols, alkyl carboxylic acids or other combinations of molecules as are found in commercially available silanes from chemical supply companies such as Gelest (Morrisville, Pa.). Some embodiments comprise mono-, di-, or tri-functional chlorosilanes, alkoxysilane or silasanes. Some embodiments comprise alkylsilanes, dialkylsilanes, polyalkylsilanes, organochlorosilanes, organodichlorosilanes, organopolychlorosilane, oxalkylsilanes, ethenylsilanes, organosilanols, organosilanethiols, organoiodosilanes. In illustrative embodiments where the chemical moieties connected to the silicon atom are not hydrolysable, the non-hydrolysable groups give rise to functionality throughout and on the surface of the silicon oxide shells. In one embodiment the silicon oxide shell is fabricated using one or more of aminopropyltriethoxy silane, aminopropyltrimethoxy silane, aminopropyltrimethoxy silane, mercaptopropyl-triethoxysilane, mercaptopropylmethoxysilane, tetramethoxy silane, and tetraethoxy silane. Silanes with one, two, three, or four terminations that can link to other silane molecules are also considered for incorporation into the silicon oxide shell. In another embodiment hydrophobic silicon oxide coatings can be obtained by encapsulating the nanoparticles with a silicon oxide coating formed via the condensation of silane molecules with hydrophobic functional groups. For example, the condensation of fluorosilane derivatives such as (tridecafluoro-1,1,2,2-tetrahydrooctyl)triethoxysilane and (heptadecafluoro-1,1,2,2,-tetrahydrodecyl)triethoxysilane onto the surface of the nanoparticles will render the surface of the nanoparticles hydrophobic. In one embodiment the condensation is performed in an alcohol solvent such as ethanol, methanol, butanol, or isopropyl alcohol. In one embodiment the condensation is performed in a basic environment using a basic material such as ammonium hydroxide. In one embodiment, the ratio of the mass of the cores to the mass of the silane is calculated to produce silicon oxide shells that are in the range from 7 nm to 50 nm in thickness. In one embodiment the silicon oxide-shelled particles are heated during or after shell formation. In one embodiment the solution is heated to great than 90° C.

In an illustrative embodiment of the present invention, the aluminum silicate shell is formed from the condensation of one or more silanes to form a silicon oxide shell followed by the exposure of the silicon oxide shell to an aluminum moiety. In another embodiment the alumina-silica shell is formed from the condensation of one or more silanes in the presence of an aluminum moiety. Silicon oxide-coated core particles can be exposed to an aluminum moiety, which can be in the form of any chemical compound that dissolves to release an aluminum ion. In one embodiment, aluminum salts may be, for example, one or more of aluminum acetate, aluminum phosphate monobasic, aluminum sulfate, aluminum ethoxide, aluminum potassium sulfate, aluminum silicate, aluminum acetate, aluminum arsenide, aluminum bromide, aluminum chloride, aluminum chloride hydrate, aluminum fluoride, aluminum fluoride hydrate, aluminum fluoride trihydrate, aluminum hydroxide, aluminum iodide, aluminum sulfide, aluminum nitrate, aluminum thiocyanate, aluminum chlorate, and aluminum nitrite. In one embodiment the aluminum salt or salt solution is added to the nanoparticles that are in the solution used to fabricate the silicon oxide shells. In another embodiment, the silicon oxide-shelled core particles are transferred to another solvent (e.g. water) before the addition of the aluminum moiety. In one embodiment, the aluminum species is useful if present in the particle solution at a concentration in the range of 5 mM to 10 mM. In one embodiment, the aluminum ion concentration is useful in the range of 5 to 10 mM. In one embodiment, the aluminum chloride is incubated with the core particles for at least 10 minutes and up to 12 hours. In one embodiment the pH of the incubation solution is adjusted to a specific pH range, for example a useful range. In one embodiment, the aluminum salt and particle solution is heated to within the temperature range of 30° C. to 120° C. In one embodiment the aluminum chloride concentration is reduced after incubation by washing the particle using multiple centrifugation steps or continuous flow filtration. In some embodiments, the concentration of aluminum chloride is reduced to 0.1% of the original concentration to remove the Cl before continuing. In one embodiment, other metal salts that comprise other elements besides aluminum can be utilized to increase the stability of the silicon oxide shells.

In an embodiment, the surface of the aluminum silicate particle is functionalized with other molecules. In one embodiment, the molecules increase the stability of the silica shell in a solvent or allow the particle to be dispersed into a different solvent. Target solvents include, water, alcohols, oils, hydrocarbons, organic solvents, polar solvents, non-polar solvents, and oleophilic and oleophobic solvents. In an embodiment, the particles are functionalized with biomolecules, proteins, or DNA. In one embodiment the particles are functionalized with a linker molecule that connects molecules on the surface of the particle to another molecule that binds to the target molecule. In one embodiment the linker molecule is a heterobifunctional molecule. Examples of heterobifunctional molecules include pegylated molecules. In one embodiment the particle is incubated with a heterobifunctional linker molecule in the presence of one or more chemicals that promote the covalent attachment of the linker molecule to the surface of the particle.

Figure 28:
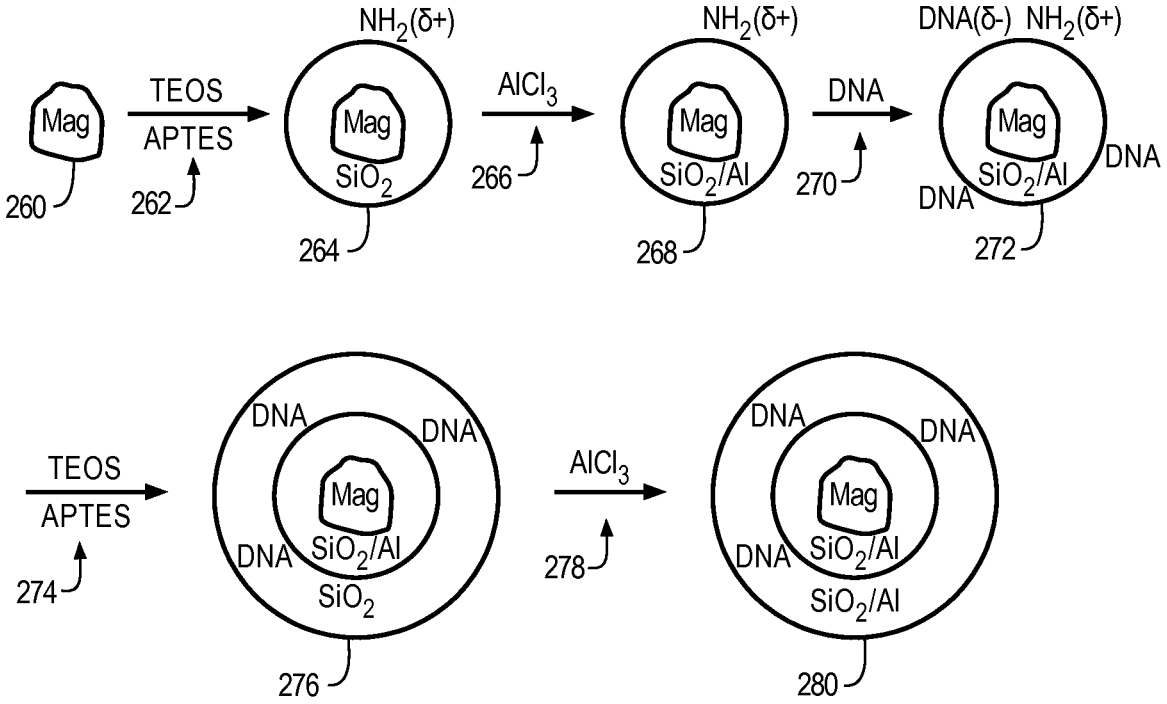
FIG. 28 is a chemical sequence diagram according to an illustrative embodiment of the present invention.

Reference is directed to FIG. 28, which is a chemical sequence diagram according to an illustrative embodiment of the present invention. In this illustrative embodiment, a single nanoparticle of magnetite 260 is used as the base of the core 264. The magnetite particles 260 are sequentially processes to form silicon oxide and aluminum silicate coatings, adhere DNA to the core, and to cover the core with a shell that is initially silicon oxide, that is converted to aluminum silicate. In this illustrative embodiment, the tracing particle chemical build-up process is as follows. The magnetite nanoparticle 260 is combined with amino functionalized silane, which acts as a coupling agent, and which is aminopropyltrimethoxy silane (APTES), and tetraethyl orthosilicate (TEOS) in a basic ethanol and water solution to form an amino functionalized magnetic silicon oxide particle 264. The formation occurs through the condensation of the silanes to form a silicon oxide coating on the magnetite particle 260. Note that this silicon oxide coated particle 264 has a delta-positive charge by virtue of the silane moiety. The TEOS and APTES are together referred to by reference numeral 262 in FIG. 28. Next, the silicon oxide particle 264 is transformed into an aluminum silicate particle 268 through exposure to an aluminum moiety.

The aluminum moiety in FIG. 28 is aluminum chloride 266, which is dissolved into a water solution with the silicon oxide core particle 264. This dissolved aluminum chloride releases aluminum ions, which bind with the silicon oxide compounds of the particle 264 to transform the particle into an aluminum silicate particle 286. The binding occurs during an incubation period in the range from 10 minutes to 24 hours. The aluminum chloride concentration is reduced after incubation by washing the particle using multiple centrifugation steps or continuous flow filtration. Note that the delta positive silane moiety remains with the aluminum silicate particle 268, making it a cationic nanoparticle. This charge is useful for adhering DNA to the core particle 268.

DNA (oligonucleotides) 270 are incorporated within the aluminum silicate that encapsulates the core 268. This is accomplished by mixing a specific DNA sequence 270 with the cationic magnetic aluminum silicate nanoparticle 268, and allowing them to incubate from a period of one hour, or longer. Since the DNA naturally has a delta-negative charge, the two components are drawn together by electrostatic attraction. This results in a core particle that has DNA adhered thereto 272. Centrifugation or tangential flow filtration is used to transfer the particles into an alcohol and water mixture.

The next step in the diagram of FIG. 28 is to encapsulate the DNA coated core particle 272. This is accomplished in essentially the same manner as the magnetite particle was coated. Specifically, TEOS and APTES 274 are added to the alcohol and water mixture, which causes the silicon oxide components to condense and form a silicon oxide shell layer on the particle 276. The solution is rinsed and replaced with water into which aluminum chloride 278 is dissolved. The aluminum ions combine with the shell to form an aluminum silicate shell particle 280.

During development of the illustrative embodiments of the present invention, it was useful to compare the stability of aluminum silicate and silicon oxide nanoparticle shells so as to evaluate performance of these options. In a 20 mL glass scintillation vial, 5 mL of 80 nm polyvinylpyrollidone (PVP) capped Biopure silver at a concentration of 1 mg/mL (nanoComposix, Inc.) was diluted with 10 mL of EtOH. The mixture was heated to 60° C. and 79 μL of 28% aqueous ammonium hydroxide solution was added followed by 18.3 μL of a 20 μL/mL solution of aminopropyltrimethoxysilane in ethanol. After fifteen minutes, 91.6 μL, of a 20 μL/mL TEOS solution was added. The vial was capped and allowed to stir over night.

In further testing during development, 250 μL of the silicon-oxide-shelled silver as synthesized was diluted to 1 mL in a microcentrifuge tube with either 0.1% 20000 MWT PEG solution or 5 mM $AlCl_3$ and allowed to incubate for 10 minutes. The PEG and $AlCl_3$ solutions were spun for 5 minutes at 10000 rpm in a microcentrifuge. The supernatant was removed and each of the solutions was diluted to 1 mL with deionized water. The centrifuge spin and redispersion in water was performed one additional time for each solution. The two solutions incubated at room temperature for 72 hours. A 2 μL aliquot of each material was dried down on a 300 mesh carbon coated formvar TEM grid and subsequently imaged. The aluminum silicate shells were intact and unchanged in thickness after 72 hours. The silicon oxide shells that were not treated with $AlCl_3$ were completed dissolved and no silicon oxide shell was visible on the TEM.

In further development of the illustrative embodiments presented herein, magnetite nanoparticles were isolated from magnetic ink printer cartridges, and were treated with a mixture of aminopropyltrimethoxysilane and tetraethylorthosilicate under base hydrolysis conditions in alcohol. 2 mL of a 22.3 mg/mL solution of polyvinylpyrrolidone capped magnetite particles were prepared at 1 mg/mL in a 3:1 ethanol: water solution. To this solution, 0.22 mL of a 30% $NH_4OH$ solution (Sigma Aldrich) was added. After 5 minutes of magnetic stirring, a total of 0.79 mL of a freshly prepared solution of 66 μL, of tetraethylorthosilicate, 20 μL of 1:20 aminopropyltrimethoxysilane in ethanol, and 700 μL of ethanol was added and the solution was allowed to stir overnight. After isolation of the particles from the alcoholic base solution by centrifugation and water wash, the magnetic nanoparticles that are encapsulated by silicon oxide were treated with a solution of $AlCl_3$ in water (5 mM) for 1 hour followed by isolation and washing by centrifugation. The zeta potential of the aluminum chloride treated particles was +45 mV at pH 7.

In further development of the illustrative embodiments presented herein, 1 mL of the cationic magnetic silicon oxide particles was diluted to 6.5 mL with water. 200 μL of 0.459 μg/mL of bacterially derived plasmid DNA was added. The suspension was incubated overnight at room temperature. Excess DNA was removed from the particles via centrifugation. A reduced zeta potential (+20 mV) indicates that DNA binding has occurred. An encapsulating aluminum silicate shell is grown to help protect the bound DNA from high temperatures and chemical reaction. The aqueous particle solution is treated with aminopropyltrimethoxysilane and tetraethylorthosilicate in water. The particles are mixed with 2.5 mL of water and 5 mL of ethanol. 6.8 μL of freshly prepared aminopropyltrimethoxysilane at 50 μL/mL in ethanol is added. After ten minutes, 680 μL of freshly prepared tetraethylorthosilicate at 50 μL/mL in ethanol is added. The solution is incubated for 48 hours.

In further development of the illustrative embodiments presented herein, the magnetic DNA nanoparticles were isolated with a magnet and rinsed from reaction byproducts. Half of the particles were incubated in a 5 mM solution of $AlCl_3$ for 3 hours before again isolating via magnet and washing with water. After heating, both the $AlCl_3$ and untreated magnetic DNA nanoparticles to 90° C. for 24 hours, the DNA was recovered from the particles by treatment of the particles with an ammonium buffered HF solution followed by isolation on a Qiagen DNA concentration spin column. The particles were isolated using centrifugation or on a magnet and were soaked in an aqueous solution of $NH_4F$/HF and NH4F (150 μL of 1 M solution of each) for ten minutes with bath sonication. DNA was isolated with a QIAquick PCR purification kit from Qiagen utilizing the materials and instructions contained therein. Subsequent qPCR of the DNA demonstrated that >40% of the DNA could be recovered for the $AlCl_3$ treated particles while <10% of the DNA could be recovered from the particles that were not treated with $AlCl_3$.

In further development regarding the coating of clusters of magnetic nanoparticles in the illustrative embodiments, clusters of magnetic nanoparticles were prepared as described in "Assembly of Magnetically Tunable Photonic Crystals in Nonpolar Solvents", JACS Communications, 131, 3484-3486, 2009. Clusters of magnetic nanoparticles were coated with silicon oxide by adding 0.5 mL of $NH_4OH$ and 10 mL of ethanol to 1.5 mL of coated clusters of magnetic nanoparticles. 75 μL of TEOS was added and the material was shaken at 600 RPM on a vortexer for 1 hour. After 1 hour, a second injection of 75 μL TEOS was added to the solution and vortexed for 1 hour. The sample was split into two equal aliquots. One aliquot was treated with 1 mL of 25 mM $AlCl_3$ for 10 minutes. Both samples were separated with a magnet and washed with water. 100 μL of the aluminum silicate-shelled magnetic nanoparticles were added to 10 mL of solution and allowed to incubate at 30° C. for 72 hours. A 100 μL aliquot of untreated silicon oxide magnetic nanoparticles was also incubated under the same conditions. TEM analysis of the magnetic nanoparticles after 72 hours shows that the non-$AlCl_3$ treated silicon oxide shell has partially dissolved and an increase in the shell porosity is observed for the sample that was not exposed to aluminum chloride. There was no change to the $AlCl_3$ silicon oxide shell over the 72 hour period.

In further development regarding the use of aluminum silicate shells on clusters of magnetic nanoparticles in the illustrative embodiments highly water-soluble magnetite nanocrystals with average size of 11.5 nm were synthesized in solution at high temperature following the procedure outlined in (J. Ge, L. He, J. Goebl, and Y. Yin, "Assembly of Magnetically Tunable Photonic Crystals in Nonpolar Solvents, (2009) JACS, 131 (10), 3484). A mixture of 4 mM of poly(acrylic acid), 2 mM of $FeCl_3$, and 15 mL of diethylene glycol (DEG) was heated to 220° C. in a nitrogen atmosphere with vigorous stirring. 4 mL of NaOH/DEG stock solution (2.5 mol/L) was then injected into the above solution, which turned black immediately. After the temperature reached 220° C. again, another 5 mL of FeCl3 stock solution (0.4 mol/L) was added into the reaction mixture. Another 3 mL of NaOH/DEG stock solution (2.5 mol/L) was then injected at 220° C. The resulting mixture was further heated for 10 minutes to yield 11.5 nm $Fe_3O_4$ nanocrystals. These colloids were first washed with a mixture of deionized (DI) water and ethanol several times to remove additional surfactant and salt, and finally dispersed in 1 mL of DI water. The volume fraction of $Fe_3O_4$ in the final ferrofluid was about 5%. 0.5 mL of the ferrofluid was diluted to 3 mL and was mixed with ethanol (20 mL), aqueous ammonia (28%, 1 mL) under vigorous magnetic stirring. Tetraethylorthosilicate (0.2 mL) was injected to the solution, and the mixture was allowed to react for 40 min. The silicon oxide-shelled $Fe_3O_4$ clusters were centrifuged and resuspended in a 5 mM solution of $AlCl_3$ for 15 minutes. The aluminum silicate coated $Fe_3O_4$ nanoclusters were centrifuged and suspended in water. The magnetically induced optical properties of the aluminum chloride treated particles remained stable for 20 days in water while the untreated particles had a degraded optical signature.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A method of tracing fracking liquid in oil or gas bearing formations using plural unique DNA sequences as fluid markers, comprising the steps of:

a) for each of the plural unique DNA sequences, encapsulating one of the plural unique DNA sequences within tracing particles, which range in size between 1 nm and 10 μm, by;
   1) providing particle cores having magnetic components therein;
   2) encapsulating the particle cores and the one of the plural unique DNA sequences by depositing a silicon compound shell about the particle cores, thereby producing encapsulated DNA particles;

b) pumping plural volumes of fracking liquid, each marked with a predetermined quantity of the encapsulated DNA particles, into the formation, thereby defining plural fracture zones;

c) pumping fluids out of the formation while taking plural well fluid samples;

d) for at least one of the plural well fluid samples;
   1) gathering and concentrating plural encapsulated DNA particles from the at least one of the plural well fluid samples using magnetic attraction with the magnetic components in particle cores;
   2) dissolving the silicon compound away from the magnetic components in the plural encapsulated DNA particles using a solution comprising hydrofluoric acid, thereby placing the plural unique DNA sequences into the solution; and
   3) measuring a quantity of each of the plural unique DNA sequences in the solution;

e) determining ratios of the plural volumes of fracking liquid recovered in the at least one of the plural well fluid samples based on the quantity of the plural unique DNA sequences in the solution.

2. The method of claim 1, further comprising the step of:
selecting the plural unique DNA sequences from oligonucleotide chains that are hexamers or longer.

3. The method of claim 1, and wherein:
the magnetic components are ferromagnetic or superparamagnetic materials selected from iron, nickel, cobalt, neodymium, aluminum, platinum, boron, yttrium, gadolinium, and dysprosium, as well as compounds and oxides thereof, and Heusler alloys, and which provide a magnetic response in the presence of a magnetic field that is sufficient for enabling collection thereof using the magnetic field.

4. The method of claim 1, and wherein:
the magnetic components are singular nanoparticles of a magnetic material.

5. The method of claim 1, and wherein:
the magnetic components in the particle cores are aggregated clusters of magnetic nanoparticles.

6. The method of claim 1, and wherein:
the step of providing particle cores is accomplished by encapsulating magnetic material in a silicon oxide material.

7. The method of claim 6, further comprising the step of:
dispersing plural magnetic nanoparticles in the silicon oxide material.

8. The method of claim 1, and wherein:
the step of providing particles cores includes providing particle cores that have a median maximum dimension that is less than 200 nanometers.

9. The method of claim 1, and wherein:
said encapsulating particle cores step is accomplished using a silicon compound including a three dimensional network of silicon atoms where a silicon atom is connected by at least one oxygen atom to another silicon atom.

10. The method of claim 9, and wherein:
the three-dimensional network comprises a first plurality of molecular units having a chemical formula $SiO_x(OH)_y$, wherein $x+y\leq 4$ and $x\geq 1$, and, a second plurality of molecular units having a chemical formula $SiO_a(OH)_bR_e$, wherein $a+b+c\leq 4$, $a\geq 1$ and R is a chemical group having a carbon atom that is directly bonded to a silicon atom.

11. The method of claim 1, further comprising the steps of:
binding the one of the plural unique DNA sequences to the particle cores using electrostatic force, covalent bonding, or physisorption prior to said encapsulating step.

12. The method of claim 1, further comprising the step of:

incorporating aluminum into the silicon compound shell by exposing the silicon compound shells to an aluminum-containing material during said encapsulating step.

13. The method of claim 12, and wherein:

said incorporating aluminum step further comprises incorporating aluminum into a three-dimensional network such that the three dimensional network is modified to include a third plurality of molecular units having a chemical formula $AlO_m(OH)_n$, wherein $m+n \leq 6$ and $m \geq 1$, and wherein at least one oxygen atom in each of the first, second and third molecular units is covalently bonded to two silicon atoms, to a silicon atom and an aluminum atom, or to two aluminum atoms.

14. The method of claim 12, and wherein said incorporating aluminum step further comprises:

exposing the silicon compound shells to a solution having an aluminum salt dissolved therein.

15. The method of claim 14, and wherein:

the aluminum salt is aluminum chloride.

16. The method of claim 14, and wherein:

the concentration of the aluminum salt in the solution is in the range of 0.1 mM to 100 mM.

17. The method of claim 14, and wherein:

said incorporating aluminum step is performed after said encapsulating the particle cores step by transferring particle cores encapsulated with the silicon compound shells to an aqueous solvent before the aluminum salt is dissolved therein.

18. The method of claim 12, and wherein:

said incorporating aluminum step is performed during said encapsulating the particle cores step by adding an aluminum salt to a solution while the particle cores are being encapsulated with the silicon compound shells.

19. The method of claim 12, and wherein:

the silicon compound shells have a median thickness that is less than 100 nm, and a silicon concentration that is in the range of 10% to 50% on the basis of the weight of the silicon compound shells, and an aluminum concentration that is in the range of 0.01% to 5% on the basis of the weight of the silicon compound shells.

20. The method of claim 1, and wherein said encapsulating the particle cores step further comprises the steps of:

forming a silicon oxide via a condensation reaction in a solution containing at least one silane having a chemical formula given by $X_nSiY_{(4-n)}$, wherein $0<n<4$, and wherein one or both of X and Y is each independently selected from the group consisting of OEt, OMe, Cl, Br, I, H, alkyl, fluoroalkyl, perfluoroalkyl, alkoxide, aryl, alkyl amine, alkyl thiol and combinations thereof.

21. The method of claim 20, and wherein:

the at least one silane is selected from the group consisting of aminopropyltriethoxy silane, aminopropyltrimethoxy silane, mercaptopropyltriethoxysilane, mercaptopropylmethoxysilane, tetramethoxy silane, tetraethoxy silane, and combinations thereof.

22. The method of claim 1, and wherein said dissolving the silicon compound away step further comprises the steps of:

soaking the plural encapsulated particles in an aqueous solution of HF and $NH_4F$, using a 1 M solution of each, with bath sonication.

* * * * *